US010350849B2

(12) United States Patent
Graham et al.

(10) Patent No.: US 10,350,849 B2
(45) Date of Patent: Jul. 16, 2019

(54) METHODS AND MACHINE FOR FORMING A TWO-PIECE BLANK ASSEMBLY

(71) Applicant: WestRock Shared Services, LLC, Norcross, GA (US)

(72) Inventors: Thomas Dean Graham, Winter Garden, FL (US); Amer Aganovic, Orlando, FL (US); Kirk Steven Kempnich, II, Orlando, FL (US)

(73) Assignee: WestRock Shared Services, LLC, Atlanta, GA (US)

( * ) Notice: Subject to any disclaimer, the term of this patent is extended or adjusted under 35 U.S.C. 154(b) by 957 days.

(21) Appl. No.: 14/860,385

(22) Filed: Sep. 21, 2015

(65) Prior Publication Data

US 2017/0080666 A1 Mar. 23, 2017

(51) Int. Cl.

| | |
|---|---|
| ***B31B 50/74*** | (2017.01) |
| ***B31B 70/64*** | (2017.01) |
| ***B31B 50/72*** | (2017.01) |
| ***B31B 50/59*** | (2017.01) |
| ***B31B 50/64*** | (2017.01) |
| ***B65D 5/32*** | (2006.01) |
| ***B31B 50/62*** | (2017.01) |
| ***B31B 50/06*** | (2017.01) |
| *B31B 120/30* | (2017.01) |
| *B31B 105/00* | (2017.01) |
| *B31B 110/30* | (2017.01) |

(52) U.S. Cl.

CPC ..... *B31B 50/74* (2017.08); *B31B 50/06* (2017.08); *B31B 50/59* (2017.08); *B31B 50/624* (2017.08); *B31B 50/64* (2017.08); *B31B 50/72* (2017.08); *B31B 70/64* (2017.08); *B65D 5/328* (2013.01); *B31B 2105/00* (2017.08); *B31B 2110/30* (2017.08); *B31B 2120/30* (2017.08)

(58) Field of Classification Search

CPC ... B31B 50/74; B31B 2120/30; B31B 50/624; B31B 2105/00; B31B 2110/30; B31B 50/72; B31B 50/59; B31B 50/64; B31B 70/64; B65D 5/328

USPC ..... 493/13, 17, 23, 33, 34, 58, 68, 79, 143, 493/145, 151, 379, 393

See application file for complete search history.

(56) References Cited

U.S. PATENT DOCUMENTS

| | | | | |
|---|---|---|---|---|
| 2,776,606 | A | 1/1957 | Fischer et al. | |
| 2,801,578 | A | 8/1957 | Bayley | |
| 4,003,299 | A * | 1/1977 | Sternheimer | B31B 50/00 493/59 |
| 4,197,789 | A | 4/1980 | Moen | |

(Continued)

*Primary Examiner* — Alexander M Valvis
*Assistant Examiner* — Mobeen Ahmed
(74) *Attorney, Agent, or Firm* — WestRock IP Legal

(57) ABSTRACT

A machine for forming a joined blank assembly from first and second blanks of sheet material includes a deck coupled to a frame, and a first transfer assembly associated with the frame. The first transfer assembly is configured to position the first blank on the deck. The machine also includes a second transfer assembly associated with the frame. The second transfer assembly is configured to position the second blank in at least a partially overlying relationship to the first blank on the deck. The machine further includes at least one compression member configured to compress the second blank and the first blank together against the deck to form the joined blank assembly.

9 Claims, 12 Drawing Sheets

(56) References Cited

U.S. PATENT DOCUMENTS 4,315,752 A * 2/1982 Moen ..... B31D 5/0004 493/171
4,461,137 A 7/1984 Wood
4,499,704 A * 2/1985 Bacon ..... B65B 5/028 493/114
4,581,005 A * 4/1986 Moen ..... B31B 50/00 271/233
4,650,448 A 3/1987 Urso
4,688,370 A * 8/1987 Dighton ..... B29C 66/43121 53/284.7
4,798,571 A * 1/1989 Everman ..... B31B 70/00 493/114
4,850,948 A * 7/1989 Schmitz ..... B31D 5/0004 493/379
4,932,930 A * 6/1990 Coalier ..... B31B 50/00 493/127
4,936,815 A * 6/1990 Kirkland ..... B31B 50/00 493/125
5,041,071 A * 8/1991 Reasinger ..... B31B 70/00 493/167
5,447,487 A * 9/1995 Alberto ..... B31B 50/00 156/264
5,656,007 A * 8/1997 Olson ..... B65D 5/323 493/151
5,807,225 A * 9/1998 Nowacki ..... B65D 5/48 493/130
5,971,906 A * 10/1999 Tharpe, Jr. ..... B65D 5/003 493/124
6,015,084 A 1/2000 Mathieu et al.
6,264,034 B1 7/2001 Bacques et al.
7,381,176 B2 6/2008 Graham et al.
7,682,300 B2 3/2010 Graham et al.
8,409,064 B2 4/2013 Desertot et al.
8,939,352 B2 1/2015 Delause et al.
9,764,526 B2 * 9/2017 Aganovic ..... B65D 5/003
2003/0186797 A1 * 10/2003 Bacques ..... B31D 5/0017 493/90
2006/0068981 A1 * 3/2006 Coullery ..... B31B 50/00 493/373
2006/0100079 A1 * 5/2006 Graham ..... B31B 50/00 493/71
2006/0113364 A1 6/2006 Bonner et al.
2008/0081754 A1 * 4/2008 Plemons ..... B65D 5/0025 493/84
2011/0053746 A1 * 3/2011 Desertot ..... B31D 1/005 493/102
2011/0269609 A1 * 11/2011 Herrin ..... B65D 5/0045 493/143
2012/0040815 A1 * 2/2012 Shanton ..... B31F 5/04 493/379
2012/0111933 A1 * 5/2012 Delause ..... B65D 5/001 229/190
2013/0137563 A1 * 5/2013 Mathieu ..... B65D 5/68 493/162
2014/0073497 A1 * 3/2014 Mack ..... B65D 5/12 493/151
2014/0155238 A1 6/2014 Thompson et al.
2017/0080667 A1 3/2017 Graham et al.
2017/0320608 A1 11/2017 Schuster

* cited by examiner

METHODS AND MACHINE FOR FORMING A TWO-PIECE BLANK ASSEMBLY

BACKGROUND

The field of the disclosure relates generally to a machine for joining two blanks of sheet material, and more specifically to methods and a machine for securely coupling the two blanks together to form a two-piece blank that subsequently may be used to form a container.

Containers fabricated from paperboard and/or corrugated paperboard material are often used to store and transport goods. These containers can include four-sided containers, six-sided containers, eight-sided containers, bulk bins and/or various size corrugated barrels. Such containers are usually formed from blanks of sheet material that are folded along a plurality of preformed fold lines to form an erected container. Moreover, at least some known containers are formed using a machine. As just one example, a blank may be positioned near a mandrel on a machine, and the machine may be configured to wrap the blank around the mandrel to form at least a portion of the container. In at least some cases, the use of the machine greatly increases a rate at which the containers may be formed and/or filled with goods.

In addition, at least some known containers are formed from multiple blanks. In some cases, the use of multiple blanks facilitates forming a container with an easily removable portion, such that the container may easily be converted into a display tray. Additionally or alternatively, the use of multiple blanks facilitates forming a container with reinforced strength in selected portions of the container. However, in at least some cases, forming a container from multiple blanks using a machine requires increased complexity of the machine and/or reduces the rate at which the containers may be formed and/or filled with goods, relative to machines for forming containers from single blanks.

BRIEF DESCRIPTION

In one aspect, a machine for forming a joined blank assembly from a first blank of sheet material and a second blank of sheet material is provided. The machine includes a deck coupled to a frame, and a first transfer assembly associated with the frame. The first transfer assembly is configured to position the first blank on the deck. The machine also includes a second transfer assembly associated with the frame. The second transfer assembly is configured to position the second blank in at least a partially overlying relationship to the first blank on the deck. The machine further includes at least one compression member configured to compress the second blank and the first blank together against the deck to form the joined blank assembly.

In another aspect, a method for forming a joined blank assembly from a first blank of sheet material and a second blank of sheet material using a machine is provided. The machine includes a deck coupled to a frame, a first transfer assembly associated with the frame, a second transfer assembly associated with the frame, and at least one compression member. The method includes positioning the first blank on the deck using the first transfer assembly. The method also includes positioning the second blank in at least a partially overlying relationship to the first blank on the deck using the second transfer assembly. The method further includes compressing the second blank and the first blank together against the deck using the at least one compression member to form the joined blank assembly.

DETAILED DESCRIPTION

The methods and machine described herein for forming a two-piece blank assembly overcome the limitations of known methods for forming containers having multiple blanks. As described herein, the two-piece blank assembly forming machine is configured to form the two-piece blank assembly by strategically placing at least a portion of a second blank in a face-to-face relationship with a first blank, and adhering the two blanks together. The two piece blank assembly can then be formed into a container by another machine, such as a container forming machine with a mandrel forming section. More specifically, the methods and machine described herein include a first transfer assembly configured to position the first blank on a deck, a second transfer assembly configured to position the second blank in at least a partially overlying relationship to the first blank on the deck, and at least one compression member configured to compress the second blank and the first blank together against the deck to form the joined blank assembly. Components of the first transfer assembly, the second transfer assembly, and the deck are controlled by actuators that are operably coupled to a control system, such that the movements of the first transfer assembly, the second transfer assembly, and the deck are coordinated to enable high-speed, fully automated production of the joined blank assemblies.

Figure 1:
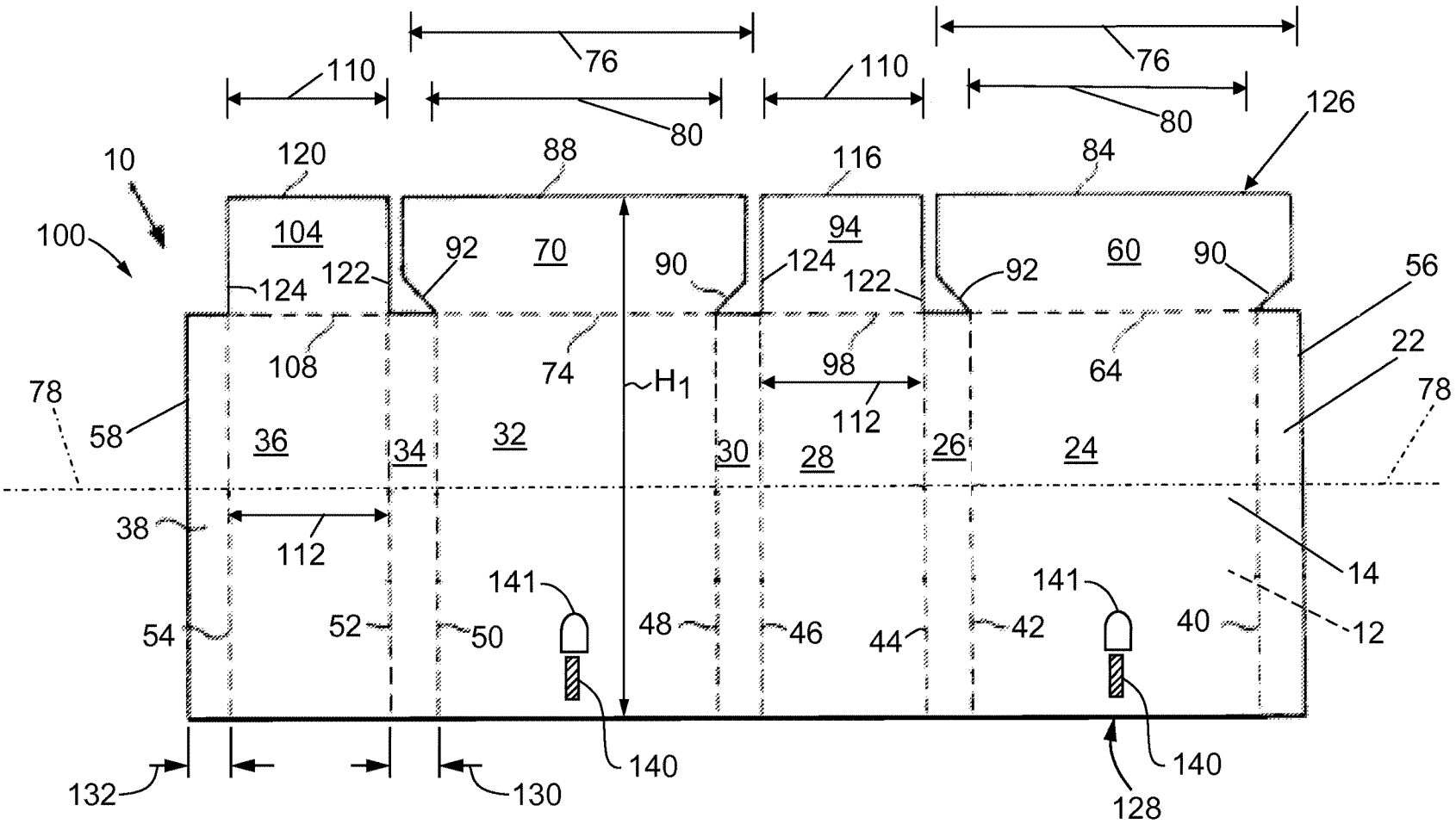
FIG. 1 is a top plan view of an example embodiment of a first blank of sheet material that may be used with the machine described herein.

FIG. 1 illustrates a top plan view of an example embodiment of a substantially flat first blank 10 of sheet material. First blank 10 includes an interior surface 12 and an opposite, exterior surface 14. First blank 10 extends from a leading edge 128 to an opposite trailing edge 126, and transversely from a first free edge 56 to a second free edge 58. A height $H_1$ of first blank 10 is defined between leading edge 128 and trailing edge 126.

First blank 10 includes a plurality of panels 100 connected together by preformed fold lines. In the example embodiment, plurality of panels 100 includes a series of aligned side panels connected together by a plurality of generally parallel fold lines. Specifically, the series of side panels includes a first corner panel 22, a first side panel 24, a second corner panel 26, a first end panel 28, a third corner panel 30, a second side panel 32, a fourth corner panel 34, a second end panel 36, and a glue panel 38 connected in series along a plurality of fold lines 40, 42, 44, 46, 48, 50, 52, and 54. First corner panel 22 extends from first free edge 56 to fold line 40, first side panel 24 extends from first corner panel 22 along fold line 40, second corner panel 26 extends from first side panel 24 along fold line 42, first end panel 28 extends from second corner panel 26 along fold line 44, third corner panel 30 extends from first end panel 28 along fold line 46, second side panel 32 extends from third corner panel 30 along fold line 48, fourth corner panel 34 extends from second side panel 32 along fold line 50, second end panel 36 extends from fourth corner panel 34 along fold line 52, and glue panel 38 extends from second end panel 36 along fold line 54 to second free edge 58. In alternative embodiments, plurality of panels 100 includes any number and shape of panels that enables first blank 10 to function as described herein.

In the example embodiment, a first top side flap 60 extends from first side panel 24 along a preformed fold line 64. Similarly, a second top side flap 70 extends from second side panel 32 along a fold line 74. Fold lines 64 and 74 are generally parallel to each other and generally perpendicular to fold lines 40, 42, 48, and 50. First top side flap 60 has a width 76 measured parallel to a central transverse axis 78 of first blank 10 that is greater than a width 80 of first side panel 24 taken along central transverse axis 78. Similarly, second top side flap 70 has width 76 greater than width 80 of second side panel 32.

First top side flap 60 includes a free edge 84, and second top side flap 70 includes a free edge 88. In the example embodiment, top side flaps 60 and 70 each include opposing angled edge portions 90 and 92 that are each obliquely angled with respect to respective fold lines 64 and 74. Although other angles may be used without departing from the scope of the present disclosure, in one embodiment, edge portions 90 and 92 are angled at about 45° with respect to respective fold lines 64 and 74. In alternative embodiments, each of top side flaps 60 and 70 has any suitable shape that enables first blank 10 to function as described herein. In other alternative embodiments, first blank 10 does not include at least one of top side flaps 60 and 70.

Also in the example embodiment, a first top end flap 94 extends from first end panel 28 along a fold line 98. Similarly, a second top end flap 104 extends from second end panel 36 along a fold line 108. Fold lines 98 and 108 are generally parallel to each other and generally perpendicular to fold lines 44, 46, 52, and 54. First top end flap 94 has a width 110 measured parallel to central transverse axis 78 of first blank 10 that is substantially equal to a width 112 of first end panel 28, also taken along central transverse axis 78. Similarly, second top end flap 104 has width 110 substantially equal to width 112 of second end panel 36.

First top end flap 94 includes a free edge 116, and second top end flap 104 includes a free edge 120. In the example embodiment, top end flaps 94 and 104 each include opposing side edge portions 122 and 124 that are each substantially parallel to respective fold lines 44, 46, 52, and/or 54. Although other angles may be used without departing from the scope of the present disclosure, in one embodiment, side edge portions 122 and 124 are angled at about 180° with respect to respective fold lines 44, 46, 52, and/or 54. In alternative embodiments, each of top end flaps 94 and 104 has any suitable shape that enables first blank 10 to function as described herein. In other alternative embodiments, first blank 10 does not include at least one of top end flaps 94 and 104.

In the example embodiment, each of corner panels 22, 26, 30, and 34 has a substantially equal width 130. In alternative embodiments, at least one of corner panels 22, 26, 30, and 34 has a width 130 that is other than substantially equal to width 130 of the others of corner panels 22, 26, 30, and 34. In other alternative embodiments, first blank 10 does not include corner panels 22, 26, 30, and 34. In the example embodiment, glue panel 38 has a width 132 that is approximately equal to or less than width 130 of corner panel 22. In alternative embodiments, glue panel 38 has any suitable width 132 that enables first blank 10 to function as described herein.

In the example embodiment, leading edge 128 extends linearly, and generally parallel to central transverse axis 78, across series of side panels 22, 24, 26, 28, 30, 32, 34, and 36. In alternative embodiments, leading edge 128 extends in any suitable fashion across series of side panels 22, 24, 26, 28, 30, 32, 34, and 36 that enables first blank 10 to function as described herein.

First blank 10 includes at least one fixing area 140 configured for securing first blank 10 to a second blank 210 (shown in FIG. 2) to form a joined blank assembly 310 (shown in FIG. 3), as will be described herein. In the example embodiment, the at least one fixing area 140 is located on exterior surface 14. In alternative embodiments, the at least one fixing area 140 is located on interior surface 12. In the example embodiment, the at least one fixing area 140 includes a pair of fixing areas 140 located respectively on side panels 24 and 32. Moreover, in the example embodiment, fixing areas 140 are located adjacent leading edge 128, such that second blank 210 is secured to first blank 10 in an at least partially overlying relationship adjacent leading edge 128. In alternative embodiments, fixing areas 140 are located to accommodate any suitable overlying position of second blank 210 relative to first blank 10.

In the example embodiment, first blank 10 includes a respective cutout 141 positioned adjacent each fixing area 140. In certain embodiments, second blank 210 is configured to form a tray portion of a container and first blank 10 is configured to form a removable hood portion of the container when the container is formed from joined blank assembly 310. Cutouts 141 facilitate a user locating fixing areas 140 and separating fixing areas 140 from second blank 210 to remove the hood portion from the tray portion of the container.

Figure 2:
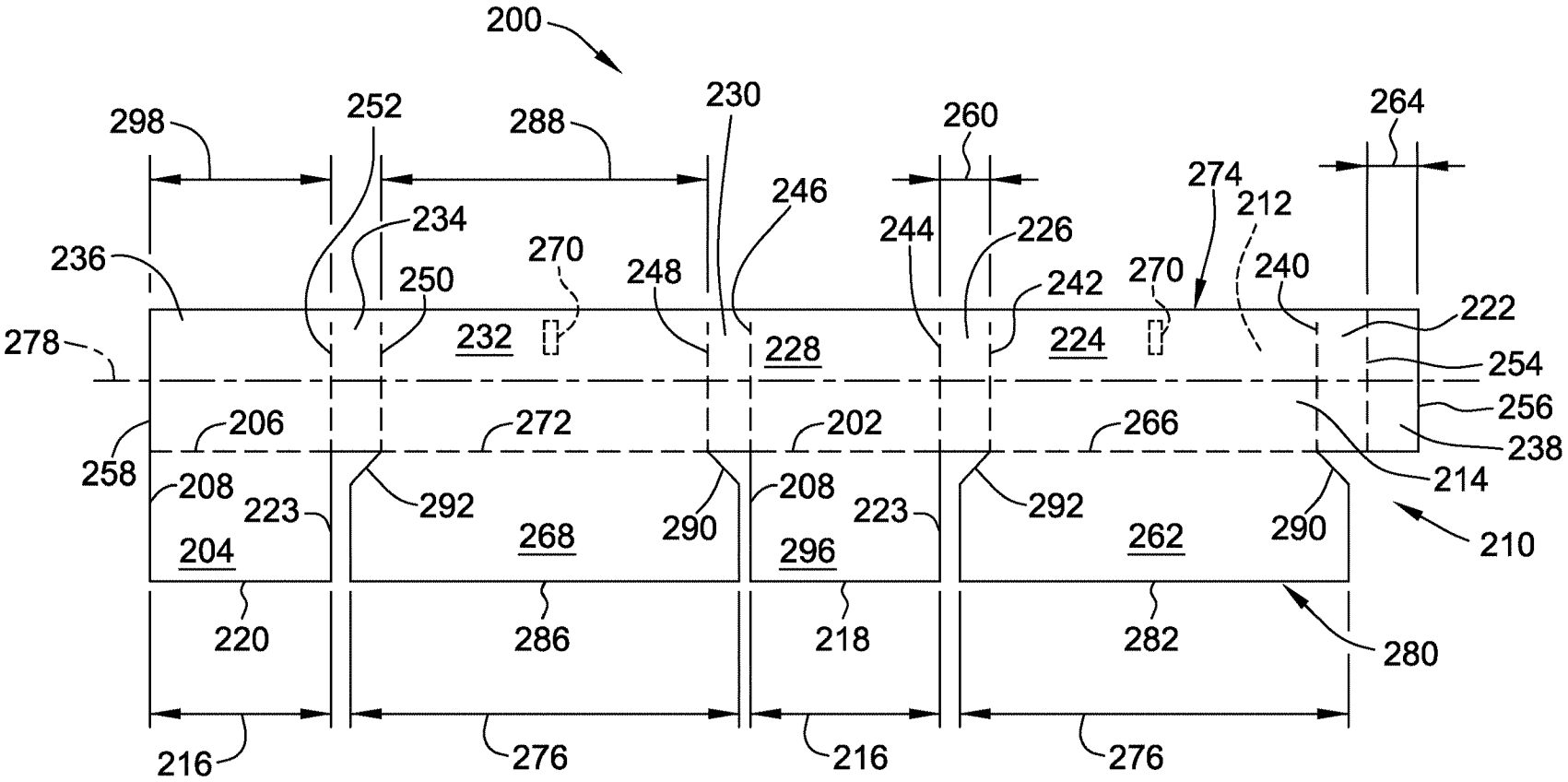
FIG. 2 is a top plan view of an example embodiment of a second blank of sheet material that may be used with the machine described herein.
Figure 3:
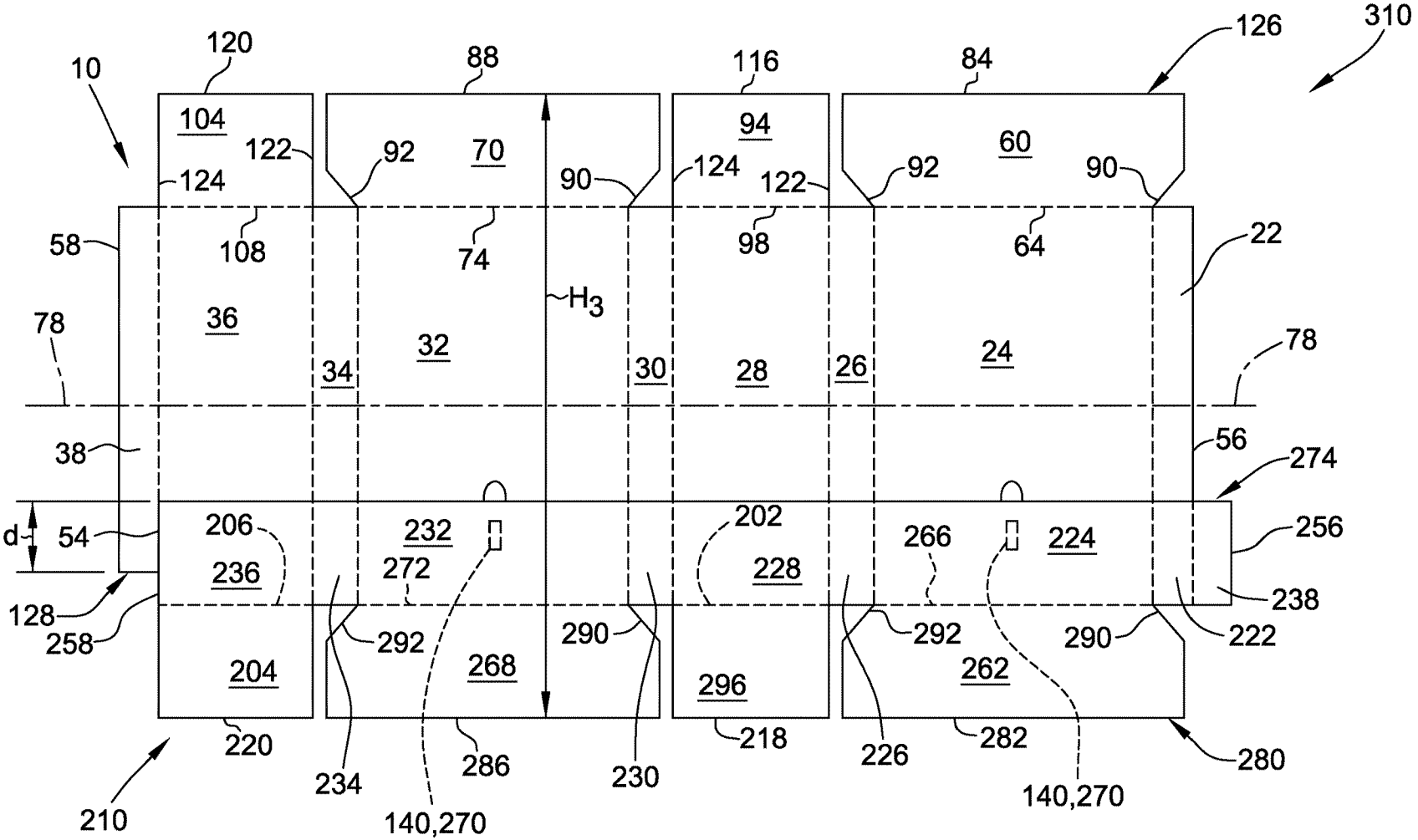
FIG. 3 is a top plan view of an example embodiment of a joined blank assembly formed from the first blank shown in FIG. 1 and the second blank shown in FIG. 2.

FIG. 2 illustrates a top plan view of an example embodiment of a substantially flat second blank 210 of sheet material. FIG. 3 illustrates a top plan view of an example embodiment of a substantially flat joined blank assembly 310 formed from second blank 210 coupled to first blank 10 in an at least partially overlying relationship, such that a container may be formed by folding joined blank assembly 310 about the preformed fold lines of first blank 10 and/or second blank 210, as described herein.

With reference to FIGS. 1-3, second blank 210 includes an interior surface 212 and an opposite, exterior surface 214. Second blank 210 extends from a leading edge 274 to an opposite trailing edge 280, and transversely from a first free edge 256 to a second free edge 258. Second blank 210 includes a plurality of panels 200 connected together by preformed fold lines. In the example embodiment, plurality of panels 200 includes a series of aligned side panels connected together by a plurality of generally parallel fold lines. Specifically, the series of side panels includes a glue panel 238, a first corner panel 222, a first side panel 224, a second corner panel 226, a first end panel 228, a third corner panel 230, a second side panel 232, a fourth corner panel 234, and a second end panel 236 connected in series along a plurality of fold lines 254, 240, 242, 244, 246, 248, 250, and 252. Glue panel 238 extends from first free edge 256 to fold line 254, first corner panel 222 extends from glue panel 238 along fold line 254, first side panel 224 extends from first corner panel 222 along fold line 240, second corner panel 226 extends from first side panel 224 along fold line 242, first end panel 228 extends from second corner panel 226 along fold line 244, third corner panel 230 extends from first end panel 228 along fold line 246, second side panel 232 extends from third corner panel 230 along fold line 248, fourth corner panel 234 extends from second side panel 232 along fold line 250, and second end panel 236 extends from fourth corner panel 234 along fold line 252 to second free edge 258. In alternative embodiments, plurality of panels 200 includes any number and shape of panels that enables second blank 210 to function as described herein.

Plurality of panels 200 is configured to at least partially align with plurality of panels 100 of first blank 10 when second blank 210 is coupled to first blank 10 to form joined blank assembly 310. For example, in the example embodiment, plurality of panels 200 of second blank 210 is configured to at least partially align with plurality of panels 100 of first blank 10 such that joined blank assembly 310 is suitably configured for wrapping about a mandrel. More specifically, in the example embodiment, the series of side panels 222, 224, 226, 228, 230, 232, 234, and 236 of second blank 210 aligns with the series of side panels 22, 24, 26, 28, 30, 32, 34, and 36, respectively, of first blank 10 when second blank 210 is coupled to first blank 10 to form joined blank assembly 310. Likewise, fold lines 240, 242, 244, 246, 248, 250, 252, and 254 of second blank 210 align with fold lines 40, 42, 44, 46, 48, 50, 52, and 54, respectively, of first blank 10 when second blank 210 is coupled to first blank 10 to form joined blank assembly 310. In alternative embodiments, plurality of panels 200 of second blank 210 is configured to at least partially align with plurality of panels 100 of first blank 10 in any suitable fashion that enables a container to be formed from joined blank assembly 310 using any suitable container-forming machine and/or by hand.

In the example embodiment, a first bottom side flap 262 extends from first side panel 224 along a preformed fold line 266. Similarly, a second bottom side flap 268 extends from second side panel 232 along a fold line 272. Fold lines 266 and 272 are generally parallel to each other and generally perpendicular to fold lines 240, 242, 248, and 250. First bottom side flap 262 has a width 276 measured parallel to a central transverse axis 278 of second blank 210 that is greater than a width 288 of first side panel 224 taken along central transverse axis 278. Similarly, second bottom side flap 268 has width 276 greater than width 288 of second side panel 232. Moreover, in the example embodiment, width 288 is substantially equal to width 80, such that side panels 224 and 232 align with side panels 24 and 32, respectively, when joined blank assembly 310 is formed. In alternative embodiments, width 288 is other than substantially equal to width 80.

First bottom side flap 262 includes a free edge 282, and second bottom side flap 268 includes a free edge 286. In the example embodiment, bottom side flaps 262 and 268 each include opposing angled edge portions 290 and 292 that are each obliquely angled with respect to respective fold lines 266 and 272. Although other angles may be used without departing from the scope of the present disclosure, in one embodiment, edge portions 290 and 292 are angled at about 45° with respect to respective fold lines 266 and 272. In alternative embodiments, each of bottom side flaps 262 and 268 has any suitable shape that enables second blank 210 to function as described herein. In other alternative embodiments, second blank 210 does not include at least one of bottom side flaps 262 and 268.

Also in the example embodiment, a first bottom end flap 296 extends from first end panel 228 along a fold line 202. Similarly, a second bottom end flap 204 extends from second end panel 236 along a fold line 206. Fold lines 202 and 206 are generally parallel to each other and generally perpendicular to fold lines 244, 246, 252, and 254. First bottom end flap 296 has a width 216 measured parallel to central transverse axis 278 of second blank 210 that is substantially equal to a width 298 of first end panel 228, also taken along central transverse axis 278. Similarly, second bottom end flap 204 has width 216 substantially equal to width 298 of second end panel 236. Moreover, in the example embodiment, width 298 is substantially equal to width 112, such that end panels 228 and 236 align with end panels 28 and 36, respectively, when joined blank assembly 310 is formed. In alternative embodiments, width 298 is other than substantially equal to width 112.

First bottom end flap 296 includes a free edge 218, and second bottom end flap 204 includes a free edge 220. In the example embodiment, bottom end flaps 204 and 296 each include opposing side edge portions 208 and 223 that are each substantially parallel to respective fold lines 244, 246, 252, and/or 254. Although other angles may be used without departing from the scope of the present disclosure, in one embodiment, side edge portions 208 and 223 are angled at about 180° with respect to respective fold lines 244, 246, 252, and/or 254. In alternative embodiments, each of bottom end flaps 204 and 296 has any suitable shape that enables second blank 210 to function as described herein. In other alternative embodiments, second blank 210 does not include at least one of bottom end flaps 296 and 204.

In the example embodiment, each of corner panels 222, 226, 230, and 234 has a substantially equal width 260. In alternative embodiments, at least one of corner panels 222, 226, 230, and 234 has a width 260 that is other than substantially equal to width 260 of the others of corner panels 222, 226, 230, and 234. In other alternative embodiments, second blank 210 does not include corner panels 222, 226, 230, and 234. Moreover, in the example embodiment, width 260 of each of corner panels 222, 226, 230, and 234 is substantially equal to width 130 of each of corner panels 22, 26, 30, and 34, respectively, such that each of corner panels 222, 226, 230, and 234 aligns with each of corner panels 22, 26, 30, and 34, respectively, when joined blank assembly 310 is formed. In alternative embodiments, width 260 of at least one of corner panels 222, 226, 230, and 234 is other than substantially equal to width 130 of the respective one of corner panels 22, 26, 30, and 34, respectively.

In the example embodiment, glue panel 238 has a width 264 that is approximately equal to or less than width 260 of corner panel 222. In alternative embodiments, glue panel 238 has any suitable width 264 that enables second blank 210 to function as described herein. In the example embodiment, glue panel 238 is disposed proximate first free edge 256, in contrast to glue panel 38 of first blank 10, which is disposed adjacent second free edge 58. In certain embodiments, configuring glue panel 38 of first blank 10 and glue panel 238 of second blank 210 to lie on opposite edges of joined blank assembly 310 facilitates forming a container from joined blank assembly 310. In alternative embodiments, glue panels 38 and 238 are located in any suitable position that enables joined blank 310 to function as described herein.

In the example embodiment, leading edge 274 extends linearly, and generally parallel to central transverse axis 278, across series of side panels 222, 224, 226, 228, 230, 232, 234, and 236. In alternative embodiments, leading edge 274 extends in any suitable fashion across series of side panels 222, 224, 226, 228, 230, 232, 234, and 236 that enables second blank 210 to function as described herein.

Second blank 210 includes at least one fixing area 270 on interior surface 212. The at least one fixing area 270 is configured to align with the at least one fixing area 140 of first blank 10 (shown in FIG. 1) for securing second blank 210 to first blank 10. Thus, in the example embodiment, the at least one fixing area 270 includes a pair of fixing areas 270 located respectively on side panels 224 and 232. The pair of fixing areas 270 are configured to align with fixing areas 140 on side panels 24 and 32 of first blank 10 when panels 200 of second blank 210 are aligned with panels 100 of first blank 10, and leading edge 274 of second blank 210 overlaps leading edge 128 of first blank 10 by a predetermined overlap distance d. In certain embodiments, predetermined overlap distance d is selected such that leading edge 128 of first blank 10 is positioned about 1/16 inch above (with respect to the view of FIG. 3) fold lines 206, 272, 202, and 266 of second blank 210. In alternative embodiments, predetermined overlap distance d is selected to be any suitable value that enables joined blank assembly 310 to function for its intended purpose. A height $H_3$ of joined blank assembly 310 is defined between trailing edge 280 of second blank 210 and trailing edge 126 of first blank 10.

Figure 4:
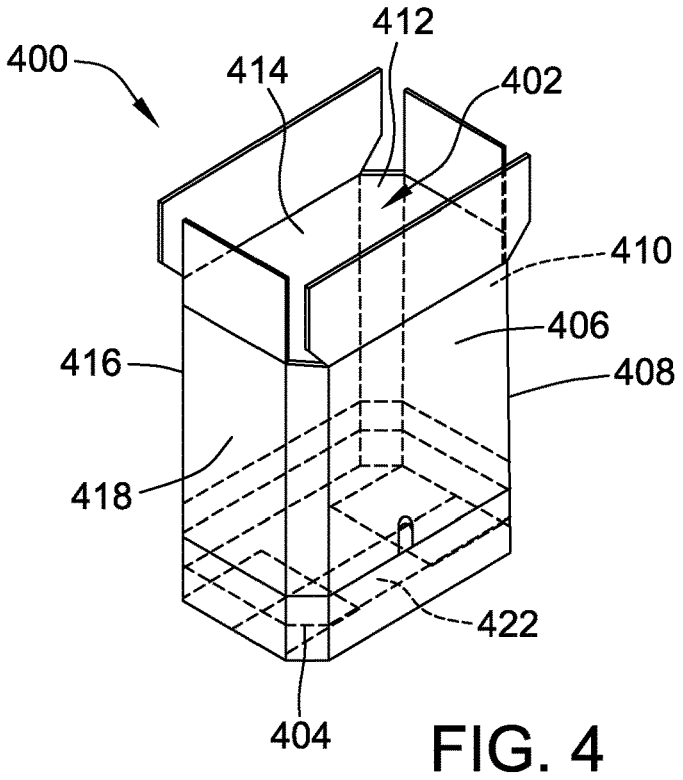
FIG. 4 is perspective view of an example embodiment of a container, shown in an open configuration, that may be formed from the joined blank assembly shown in FIG. 3.
Figure 5:
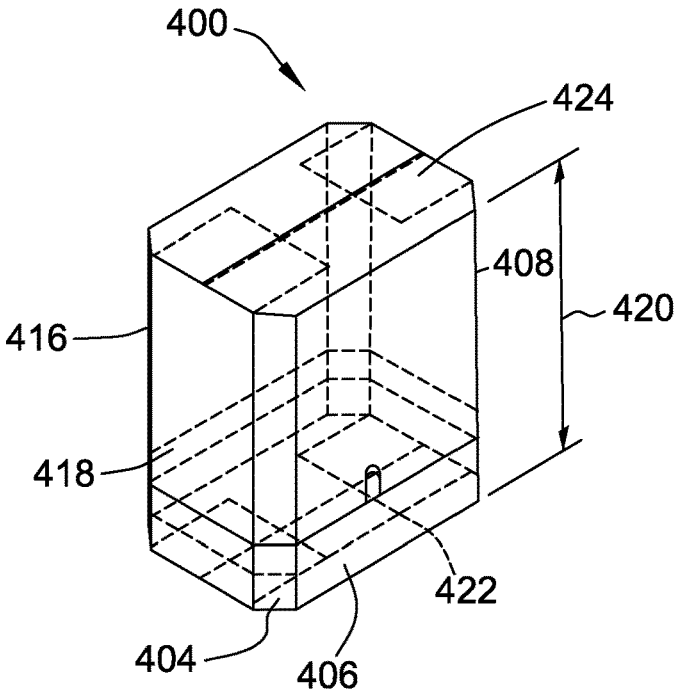
FIG. 5 is perspective view of the example container shown in FIG. 4 in a closed configuration.

As a result of the above example embodiment of joined blank assembly 310, a manufacturer's joint, a container bottom wall, and a container top wall formed therefrom may be securely closed so that various products may be securely contained within a formed container. More specifically, joined blank assembly 310 is intended to form a container 400 as shown in FIGS. 4 and 5 by folding and/or securing panels 22, 24, 26, 28, 30, 32, 34, 36, and/or 38 of first blank 10, top flaps 60, 70, 94, and/or 104 of first blank 10, panels 222, 224, 226, 228, 230, 232, 234, 236, and/or 238 of second blank 210, and bottom flaps 262, 268, 296, and/or 202 of second blank 210. Of course, blanks having shapes, sizes, and configurations different from first blank 10 and/or second blank 210 described and illustrated herein may be used to form joined blank assembly 310 and container 400 without departing from the scope of the present disclosure. In other words, the machine, processes, and control system described herein can be used to form a variety of different shaped and sized joined blanks, and is not limited to joined blank assembly 310 shown in FIG. 3 and/or container 400 shown in FIGS. 4 and 5.

FIG. 4 illustrates a perspective view of an example embodiment of a container 400, which is erected and in an open configuration, that may be formed from joined blank assembly 310. FIG. 5 illustrates a perspective view of container 400 in a closed configuration. Referring to FIGS. 1-5, in the example embodiment, container 400 includes a plurality of walls defining a cavity 402. More specifically, container 400 includes a first corner wall 404, a first side wall 406, a second corner wall 408, a first end wall 410, a third corner wall 412, a second side wall 414, a fourth corner wall 416, and a second end wall 418. First corner wall 404 includes first corner panel 22 and glue panel 38 of first blank 10 and first corner panel 222 of second blank 210. First side wall 406 includes first side panel 24 of first blank 10 and first side panel 224 of second blank 210. Second corner wall 408 includes second corner panel 26 of first blank 10 and second corner panel 226 of second blank 210. First end wall 410 includes first end panel 28 of first blank 10 and first end panel 228 of second blank 210. Third corner wall 412 includes third corner panel 30 of first blank 10 and third corner panel 230 of second blank 210. Second side wall 414 includes second side panel 32 of first blank 10 and second side panel 232 of second blank 210. Fourth corner wall 416 includes fourth corner panel 34 of first blank 10 and fourth corner panel 234 of second blank 210. Second end wall 418 includes second end panel 36 of first blank 10 and second end panel 236 and glue panel 238 of second blank 210. In the example embodiment, each wall 404, 406, 408, 410, 412, 414, 416, and 418 has a substantially equal height 420. In alternative embodiments, at least one of walls 404, 406, 408, 410, 412, 414, 416, and 418 has height 420 different from height 420 of another of walls 404, 406, 408, 410, 412, 414, 416, and 418.

In the example embodiment, first corner wall 404 connects first side wall 406 to second end wall 418, second corner wall 408 connects first side wall 406 to first end wall 410, third corner wall 412 connects first end wall 410 to second side wall 414, and fourth corner wall 416 connects second side wall 414 to second end wall 418. Further, bottom flaps 262, 296, 268, and 204 of second blank 210, form a bottom wall 422 of container 400, and top flaps 60, 94, 70, and 104 of first blank 10 form a top wall 424 of container 400. Although container 400 may have other orientations without departing form the scope of the present disclosure, in the example embodiment, end walls 410 and 418 are substantially parallel to each other, side walls 406 and 414 are substantially parallel to each other, first corner wall 404 and third corner wall 412 are substantially parallel to each other, and second corner wall 408 and fourth corner wall 416 are substantially parallel to each other. Corner walls 404, 408, 412, and 416 are obliquely angled with respect to walls 406, 410, 414, and 418 to form angled corners of container 400.

Bottom flaps 262, 296, 268, and 204 are each orientated generally perpendicular to walls 404, 406, 408, 410, 412, 414, 416, and 418 to form bottom wall 422. More specifically, bottom end flaps 296 and 204 are folded inside of bottom side flaps 262 and 268. Similarly, in the fully closed position, top flaps 60, 94, 70, and 104 are each orientated generally perpendicular to walls 404, 406, 408, 410, 412, 414, 416, and 418 to form top wall 424. Although container 400 may be secured together in any suitable fashion at any suitable location on container 400 without departing from the scope of the present disclosure, in one embodiment, adhesive (not shown) is applied to an inner surface and/or an outer surface of first corner panel 22 and/or glue panel 38 to form a first manufacturer's joint at first corner wall 404, and adhesive (not shown) is applied to an inner surface and/or an outer surface of second end panel 236 and/or glue panel 238 to form a second manufacturer's joint at second end wall 418 proximate bottom wall 422. In one embodiment, adhesive may also be applied to exterior surfaces of bottom end flaps 296 and/or 204 and/or interior surfaces of bottom side flaps 262 and/or 268 to secure bottom side flaps 262 and/or 268 to bottom end flaps 296 and/or 204. As a result of the above example embodiment of container 400, the manufacturer's joints, bottom wall 422, and/or top wall 424 may be securely closed so that various products may be securely contained within container 400. Moreover, in certain embodiments, top wall 424 and portions of walls 404, 406, 408, 410, 412, 414, 416, and 418 formed from first blank 10 are easily removable from container 400 at, for example, a retail location, revealing products supported by bottom wall 422 and portions of walls 404, 406, 408, 410, 412, 414, 416, and 418 formed from second blank 210 for display to and selection by customers. Additionally or alternatively, forming walls 404, 406, 408, 410, 412, 414, 416, and 418 using both first blank 10 and second blank 210 reinforces container 400 during shipping and/or storage of products therein.

Figure 6:
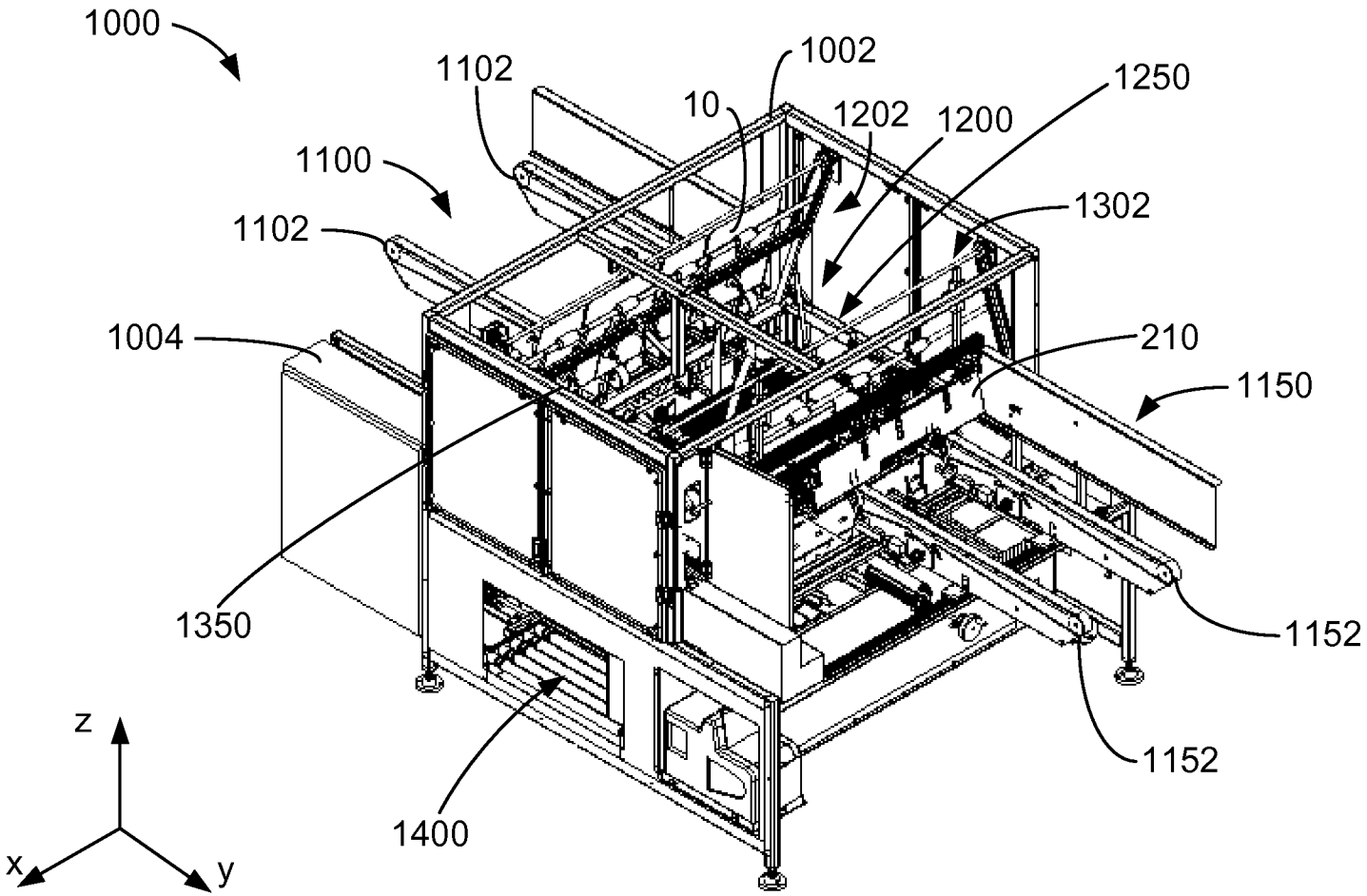
FIG. 6 is a schematic perspective view of an example embodiment of a machine that may be used to form the joined blank assembly shown in FIG. 3 from the first blank shown in FIG. 1 and the second blank shown in FIG. 2.

FIG. 6 is a schematic perspective view of an example embodiment of a machine 1000 for forming a joined blank assembly, such as joined blank assembly 310, from two separate blanks of sheet material, such as first blank 10 and second blank 210. Machine 1000 is sometimes referred to as a two-piece blank assembly forming machine. While machine 1000 will be discussed hereafter with reference to forming joined blank assembly 310 from first blank 10 and second blank 210, machine 1000 may be used to form any other joined blank assembly from any other first and second blanks each having any size, shape, and/or configuration without departing from the scope of the present disclosure.

With reference to FIGS. 1-3 and 6, machine 1000 includes a first feed section 1100, a second feed section 1150, a transfer section 1200, and an outfeed section 1400 each positioned with respect to, coupled to, and/or otherwise associated with a frame 1002. More specifically, in the example embodiment, first feed section 1100 and second feed section 1150 are positioned on opposite sides, with respect to a sheet loading direction Y, of transfer section 1200. In addition, outfeed section 1400 is located at least partially beneath transfer section 1200 in a vertical direction Z. Outfeed section 1400 is configured to discharge joined blank assemblies 310 in a discharge direction X that is generally perpendicular to sheet loading direction Y and vertical direction Z. In alternative embodiments, first feed section 1100, second feed section 1150, transfer section 1200, and outfeed section 1400 are positioned with respect to each other in any suitable fashion that enables machine 1000 to function as described herein.

A control system 1004 is coupled in operative control communication with at least one component of machine 1000. In the example embodiment, actuators are used to rotate, translate, and/or otherwise move or position various components of machine 1000, as will be described in more detail below. The actuators may include, for example, jacks, mechanical linkages, servomechanisms, other suitable mechanical or electronic actuators, or any suitable combination thereof. As described herein, a control system is any suitable system that controls the movement and/or timing of at least one actuator or other mechanically or electronically driven component of machine 1000.

In certain embodiments, such as, but not limited to, embodiments where at least one servomechanism is used, control system 1004 may enable an operator to change recipes or protocols by making a selection on a user interface. The recipes are computer instructions for controlling the machine to form different sizes and/or types of joined blank assemblies 310 from different sizes and/or types of first blanks 10 and second blanks 210. The different recipes control the speed, timing, force applied, and/or other motion characteristics of the different forming components of the machine including how the components move relative to one another.

In the example embodiment, first feed section 1100 is a magazine feed mechanism configured to receive a plurality of first blanks 10, and second feed section 1150 is a magazine feed mechanism configured to receive a plurality of second blanks 210. In the example embodiment, first feed section 1100 includes a plurality of powered belt conveyors 1102, and second feed section 1150 includes a plurality of powered belt conveyors 1152. Belt conveyors 1102 and 1152 are configured to move first blanks 10 and second blanks 210, respectively, towards transfer section 1200. In the example embodiment, first blanks 10 and second blanks 210 are loaded within feed sections 1100 and 1150 generally in the vertical direction Z. In alternative embodiments, machine 1000 is configured to receive at least one of first blanks 10 and second blanks 210 in another suitable orientation, such as, but not limited to, a generally horizontal configuration. Also in the example embodiment, a position of each feed section 1100 and 1150 with respect to frame 1002 in discharge direction X is slidably adjustable in the X direction to facilitate alignment of panels 100 of first blank 10 and panels 200 of second blank 210 upon placement of first blank 10 and second blank 210 in transfer section 1200, as will be described herein. Further in the example embodiment, feed sections 1100 and 1150 each include at least one alignment device (not shown) such as, but not limited to, a stack presser, to facilitate justifying and/or aligning first blanks 10 and second blanks 210 in respective magazines of feed sections 1100 and 1150. In alternative embodiments, first feed section 1100 and second feed section 1150 each include any suitable structure that enables first feed section 1100 and second feed section 1150 to function as described herein.

In the example embodiment, first blanks 10 are oriented in first feed section 1100 such that leading edge 128 of each first blank 10 is positioned against conveyors 1102 and exterior surface 14 faces transfer section 1200, and second blanks 210 are oriented in second feed section 1100 such that leading edge 274 of each second blank 210 is positioned against conveyors 1152 and exterior surface 214 faces transfer section 1200. In alternative embodiments, first blanks 10 and second blanks 210 are orientated in respective feed sections 1100 and 1150 in any suitable manner that enables operation of machine 1000 as described herein.

Transfer section 1200 includes a first transfer assembly 1202 coupled to and/or otherwise associated with frame 1002 proximate first feed section 1100. First transfer assembly 1202 is configured to extract one of first blanks 10 from first feed section 1100 and position the extracted first blank 10 on a deck 1250. Transfer section 1200 also includes a second transfer assembly 1302 coupled to and/or otherwise associated with frame 1002 proximate second feed section 1150. Second transfer assembly 1302 is configured to extract one of second blanks 210 from second feed section 1150 and position the extracted second blank 210 in at least partially overlying relationship to first blank 10 on deck 1250. Deck 1250 is configured to support first blank 10 and second blank 210 as they are coupled to form joined blank assembly 310.

Figure 7:
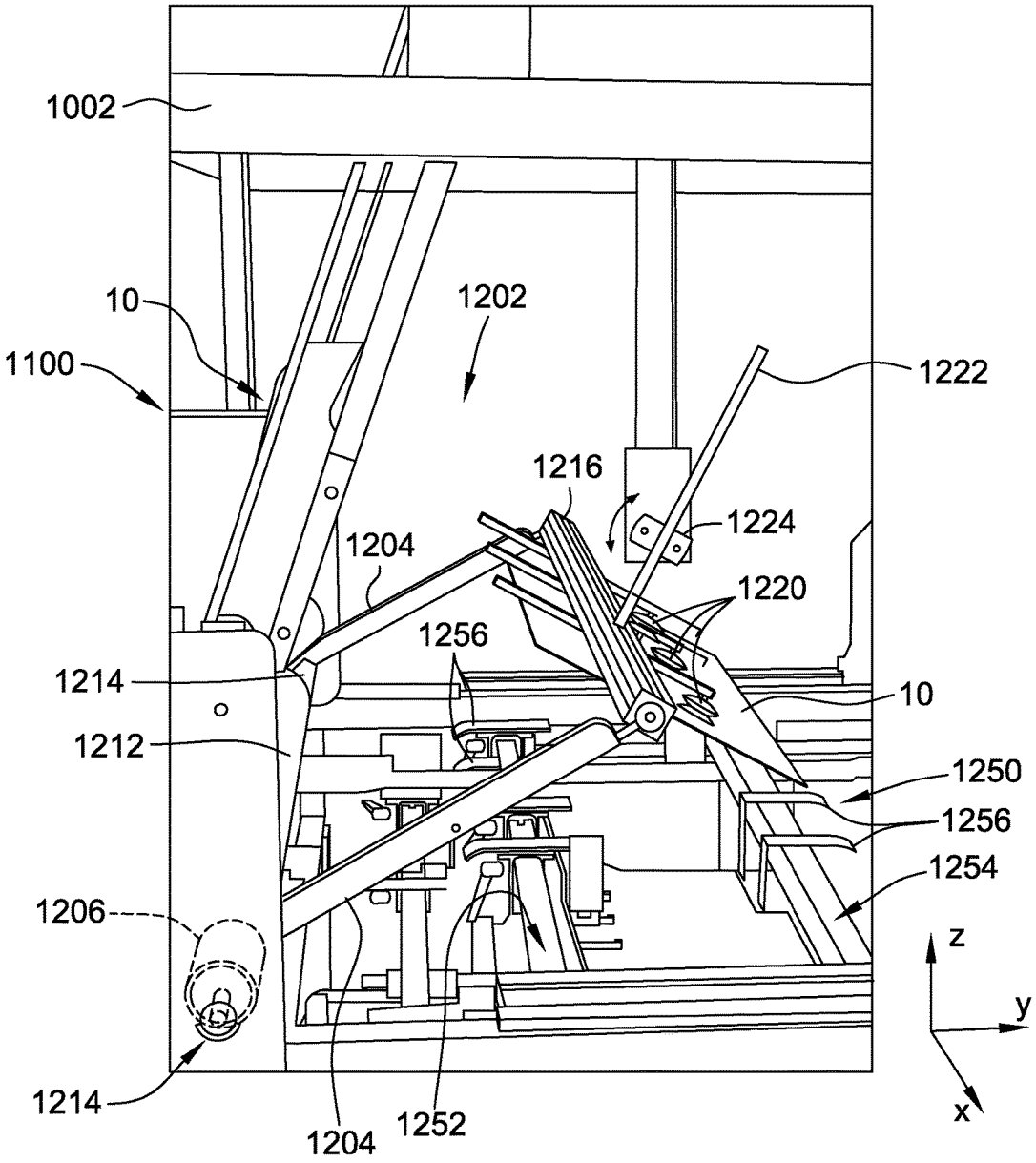
FIG. 7 is a schematic perspective view of a portion of the machine shown in FIG. 6, including an example embodiment of a transfer section of the machine.

FIG. 7 is a schematic perspective view of a portion of machine 1000, including an example embodiment of transfer section 1200. In the example embodiment, deck 1250 is coupled to frame 1002 and is selectively moveable between a first deck position, in which deck 1250 is configured to support first blank 10 and second blank 210 as they are coupled to form joined blank assembly 310, and a second deck position, in which deck 1250 is configured to enable joined blank assembly 310 to drop, with respect to vertical direction Z, into outfeed section 1400. In alternative embodiments, deck 1250 is not configured to move to a second position to enable joined blank assembly 310 to drop therebetween, in a direction parallel to vertical direction Z.

In the example embodiment, deck 1250 includes a first deck member 1252 and a second deck member 1254 coupled to frame 1002. Each deck member 1252 and 1254 includes a plurality of generally planar feet 1256. The plurality of feet 1256 are aligned in a plane generally perpendicular to vertical direction Z and are configured to support first blank 10 and second blank 210 as they are coupled to form joined blank assembly 310. More specifically, in the example, embodiment, as will be described further herein, each of first deck member 1252 and second deck member 1254 are selectively moveable between a first deck position relatively close together with respect to sheet loading direction Y, in which feet 1256 are positioned to support first blank 10 and second blank 210 as they are coupled to form joined blank assembly 310, and a second deck position relatively farther apart from each other with respect to sheet loading direction Y, such that joined blank assembly 310 fits therebetween, in a direction parallel to vertical direction Z, and is enabled to drop into outfeed section 1400. In alternative embodiments, first deck member 1252 and second deck member 1254 are not selectively moveable to the second position. In other alternative embodiments, deck 1250 includes additional or alternative suitable structure configured to support first blank 10 and second blank 210 as they are coupled to form joined blank assembly 310.

In the example embodiment, first transfer assembly 1202 includes a drive shaft 1212 supported and aligned by at least one bearing 1214. Drive shaft 1212 is aligned generally parallel to discharge direction X and is operably coupled to a suitable actuator 1206 for bi-directional rotation about its shaft axis. For example, actuator 1206 includes at least one of a hydraulic jack, an air cylinder, a mechanical linkage, a servomechanism, and another suitable mechanical or electronic actuator. A pair of arms 1204 extend from, and rotate with, drive shaft 1212. A pick-up bar 1216 is aligned parallel to drive shaft 1212, and is coupled between arms 1204 for free rotation about its bar axis. A plurality of vacuum suction cups 1220 are fixedly coupled to pick-up bar 1216. Each suction cup 1220 is operably coupled to a respective independent vacuum generator (not shown) for selectively providing suction to selectively attach suction cups 1220 to first blank 10 presented in first feed section 1100. In alternative embodiments, at least some suction cups 1220 are coupled to a common vacuum generator. Further in the example embodiment, a guide rod 1222 is fixedly coupled to pick-up bar 1216. Guide rod 1222 is slidably coupled through an aperture in a pivot block 1224. In turn, pivot block 1224 is pivotably coupled to and/or otherwise associated with frame 1002 for rotation about an axis parallel to drive shaft 1212. In alternative embodiments, first transfer assembly 1202 includes any suitable additional or alternative components that enable first transfer assembly 1202 to function as described herein.

In operation, first transfer assembly 1202 is controlled, commanded, and/or instructed to position suction cups 1220 to facilitate extracting first blank 10 from first feed section 1100 and placing first blank 10 on deck 1250. More specifically, in the example embodiment, actuator 1206 is controlled, commanded, and/or instructed to rotate drive shaft 1212 in a first direction (counterclockwise in the view of FIG. 7). As arms 1204 rotate with drive shaft 1212, guide rod 1222 and pivot block 1224 cooperate to orient pick-up bar 1216 such that suction cups 1220 are positioned in sealing contact with first blank 10, which is presented generally perpendicular to sheet loading direction Y in first feed section 1100. Actuator 1206 is then controlled, commanded, and/or instructed to rotate drive shaft 1212 in a second, opposite direction (clockwise in the view of FIG. 7). As arms 1204 rotate with drive shaft 1212, activated suction cups 1220 extract first blank 10 from first feed section 1100. Moreover, guide rod 1222 and pivot block 1224 cooperate to rotate pick-up bar 1216 such that first blank 10 is oriented generally perpendicular to vertical direction Z as pick-up bar 1216 approaches deck 1250. Finally, vacuum pressure through suction cups 1220 is controlled, commanded, and/or instructed to be de-activated, depositing first blank 10 on deck 1250. In certain embodiments, actuator 1206 is then controlled, commanded, and/or instructed to rotate drive shaft 1212 in the first direction to provide clearance for other operations of machine 1000 proximate deck 1250. For example, first transfer assembly 1202 is rotated to extract another first blank 10 and/or to pause in a neutral position to provide clearance for other operations of machine 1000 proximate deck 1250. In alternative embodiments, first transfer assembly 1202 is operated in any suitable additional or alternative fashion that enable first transfer assembly 1202 to function as described herein.

Figure 8:
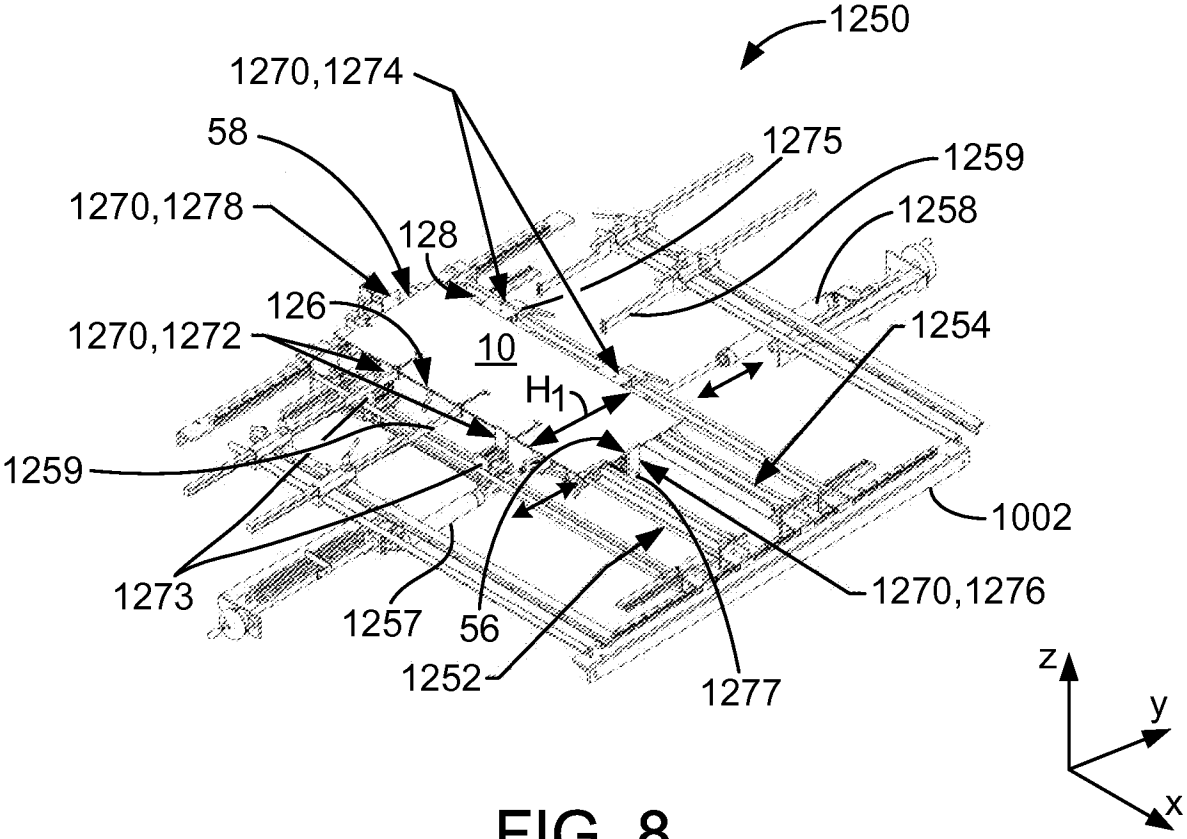
FIG. 8 is a schematic perspective view of an example embodiment of a deck of the machine shown in FIG. 6.

FIG. 8 is a schematic perspective view of an example embodiment of deck 1250. In the example embodiment, deck 1250 includes first deck member 1252 and second deck member 1254 selectively moveable between the first deck position (illustrated in FIG. 8, supporting first blank 10) and the second deck position (not shown), as described above. More specifically, first deck member 1252 is operably coupled to a first deck actuator 1257, and second deck member 1254 is operably coupled to a second deck actuator 1258. For example, each of deck actuators 1257 and 1258 includes at least one of a hydraulic jack, an air cylinder, a mechanical linkage, a servomechanism, and another suitable mechanical or electronic actuator. Deck actuators 1257 and 1258 are configured to selectively bi-directionally translate first and second deck members 1252 and 1254, respectively, in a direction generally parallel to sheet loading direction Y.

In operation, to selectively place deck members 1252 and 1254 in the first deck position, deck actuators 1257 and 1258 are controlled, commanded, and/or instructed to push deck members 1252 and 1254 towards each other in sheet loading direction Y such that feet 1256 (visible in FIG. 7) of first deck member 1252 are separated from feet 1256 of second deck member 1254 by a distance less than a height $H_1$ of first blank 10. To selectively place deck members 1252 and 1254 in the second deck position, in which feet 1256 are positioned to enable joined blank assembly 310 to drop therebetween in a direction parallel to vertical direction Z, deck actuators 1257 and 1258 are controlled, commanded, and/or instructed to pull deck members 1252 and 1254 away from each other in sheet loading direction Y such that feet 1256 (visible in FIG. 7) of first deck member 1252 are separated from feet 1256 of second deck member 1254 by a distance greater than a height $H_3$ (shown in FIG. 3) of joined blank assembly 310. In alternative embodiments, first deck member 1252 and second deck member 1254 are selectively moveable between the first deck position and the second deck position in any suitable fashion that enables transfer section 1200 to function as described herein.

Further in the example embodiment, transfer section 1200 includes a pair of secondary stops 1259 coupled to frame 1002. In some instances during separation of deck members 1252 and 1254 towards the second position, joined blank assembly 310 tends to be dragged parallel to the Y direction by one of deck members 1252 and 1254. A first secondary stop 1259 is positioned proximate trailing edge 126 of first blank 10 of joined blank assembly 310, and a second secondary stop 1259 is positioned proximate trailing edge 280 of second blank 210 of joined blank assembly 310, such that if joined blank assembly 310 is dragged parallel to the Y direction by one of deck members 1252 and 1254, one of secondary stops 1259 bears against the respective one of trailing edge 126 and trailing edge 280 to facilitate maintaining joined blank assembly 310 generally centered above outfeed section 1400 while deck members 1252 and 1254 move to the second position. Secondary stops are adjustable parallel to the Y direction to accommodate different sizes of first blanks 10, second blanks 210, and/or joined blank assemblies 310. In alternative embodiments, transfer section 1200 includes additional or alternative suitable structure configured to facilitate maintaining joined blank assembly 310 generally centered above outfeed section 1400 while deck members 1252 and 1254 move to the second position.

Further in the example embodiment, transfer section 1200 includes a first alignment system 1270 configured to precisely align first blank 10 with respect to deck 1250. For example, in the example embodiment illustrated in FIG. 8, first alignment system 1270 includes at least one first tamp 1272 and at least one first stop 1274. A position of first stop 1274 relative to deck 1250 in sheet loading direction Y is predetermined based on a desired position of first blank 10 relative to deck 1250. Each first tamp 1272 is operably coupled to a suitable actuator 1273 for pushing trailing edge 126 of first blank 10 in sheet loading direction Y, such that leading edge 128 of first blank 10 is coupled against first stop 1274. In alternative embodiments, first alignment system 1270 includes additional or alternative structure suitable to align first blank 10 with respect to deck 1250 in the Y direction.

Moreover, in the example embodiment, first stop 1274 is operably coupled to a suitable actuator 1275 for movement in a direction parallel to vertical direction Z. More specifically, first stop 1274 is selectively moveable between a first position above feet 1256 (shown in FIG. 7), such that leading edge 128 is coupleable against first stop 1274 when first blank 10 rests on feet 1256, and a second position below feet 1256, such that first stop 1274 does not interfere with subsequent placement of second blank 210 in at least partially overlying relationship with first blank 10, as will be described herein. In other words, first stop 1274 pops up above the plane of deck 1250 when needed to cooperate with operation of first tamp 1272, and then pops back down below the plane of deck 1250 to avoid interference with positioning of second blank 210 on deck 1250. In alternative embodiments, first stop 1274 is not selectively moveable in the Z direction.

In the example embodiment, first alignment system 1270 further includes at least one second tamp 1276 and at least one second stop 1278. A position of second stop 1278 relative to deck 1250 in discharge direction X is predetermined based on a desired position of first blank 10 relative to deck 1250. Second tamp 1276 is operably coupled to a suitable actuator 1277 for pushing first free edge 56 of first blank 10 opposite discharge direction X, such that second free edge 58 of first blank 10 is coupled against second stop 1278. In alternative embodiments, first alignment system 1270 includes additional or alternative structure suitable to align first blank 10 with respect to deck 1250 in the X direction. In other alternative embodiments, transfer section 1200 does not include first alignment system 1270.

In operation, after first blank 10 is deposited on deck 1250, first tamp 1272 is controlled, commanded, and/or instructed to push first blank 10 in sheet loading direction Y such that leading edge 128 is coupled against first stop 1274. Similarly, second tamp 1276 is controlled, commanded, and/or instructed to push first free edge 56 of first blank 10 opposite discharge direction X such that second free edge 58 of first blank 10 is coupled against second stop 1278. In certain embodiments, first tamp 1272 is then controlled, commanded, and/or instructed to retract from first blank 10 opposite sheet loading direction Y and first stop 1274 is controlled, commanded, and/or instructed to move to the second position below feet 1256, such that first stop 1274 will not interfere with subsequent placement of second blank 210 in at least partially overlying relationship with first blank 10. In some such embodiments, a continued tamping force applied by second tamp 1276 maintains a previously established alignment of first blank 10 relative to deck 1250 in both the X and Y directions after first tamp 1272 is retracted and first stop 1274 is lowered, and second tamp 1276 is then retracted prior to moving deck 1250 to the second position to release joined blank assembly 310 to outfeed section 1400.

Figure 9:
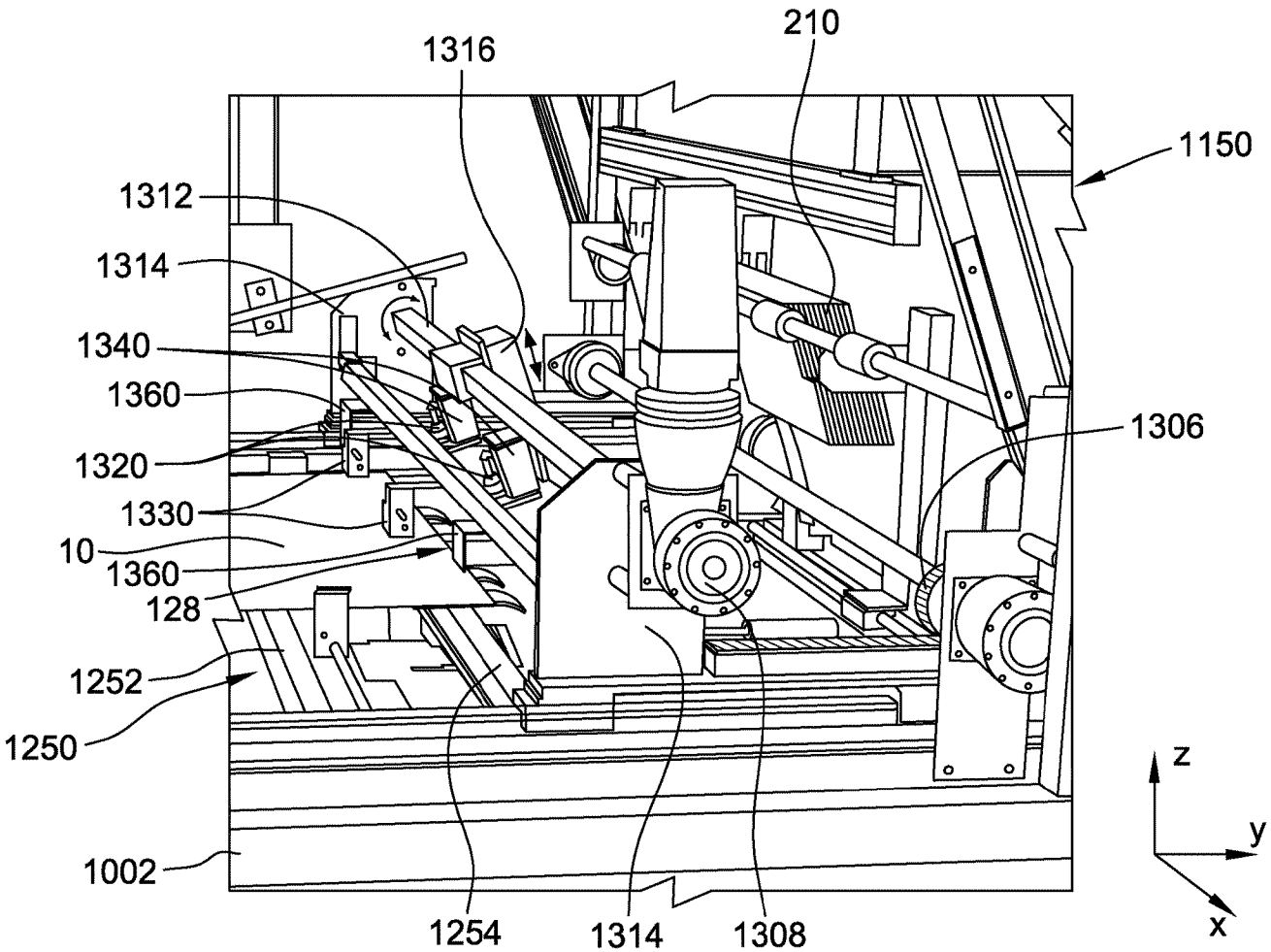
FIG. 9 is a schematic perspective view of another portion of the example machine shown in FIG. 6, with an example embodiment of a second transfer assembly illustrated in mid-transfer of the second blank shown in FIG. 2 to the deck shown in FIG. 8.
Figure 10:
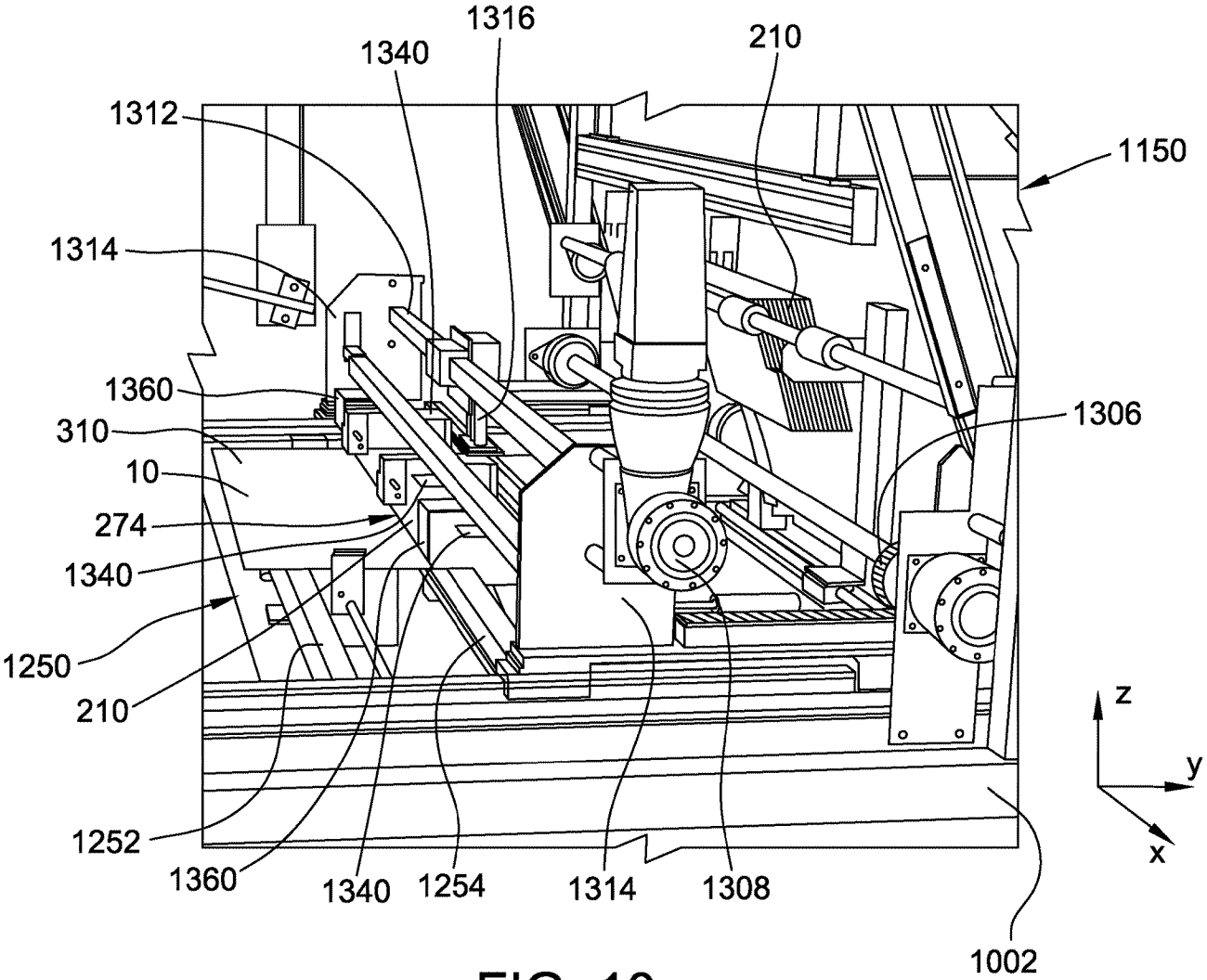
FIG. 10 is a schematic perspective view of the portion of the example machine shown in FIG. 9, with the example second transfer assembly illustrated compressing the second blank shown in FIG. 2 against the first blank shown in FIG. 1 to form the joined blank assembly shown in FIG. 3.

FIG. 9 is a schematic perspective view of another portion of machine 1000, with second transfer assembly 1302 in mid-transfer of second blank 210 from second feed section 1150 to deck 1250. FIG. 10 is a schematic perspective view of the portion of machine 1000 shown in FIG. 9, with second transfer assembly 1302 compressing second blank 210 against first blank 10 to form joined blank assembly 310.

With reference to FIGS. 9 and 10, in the example embodiment, second transfer assembly 1302 includes a drive shaft 1312 supported and aligned by a bearing structure 1314. Drive shaft 1312 is aligned generally parallel to discharge direction X and is operably coupled to an actuator 1308 for bi-directional rotation about its shaft axis relative to bearing structure 1314. For example, actuator 1308 includes at least one of a hydraulic jack, an air cylinder, a mechanical linkage, a servomechanism, and another suitable mechanical or electronic actuator. Drive shaft 1312 enables second transfer assembly 1302 to rotate an extracted second blank 210 from the orientation of second blank 210 as presented in second feed section 1150 to an orientation generally parallel to first blank 10 positioned on deck 1250.

Also in the example embodiment, bearing structure 1314 is operably coupled to an actuator 1306 for bi-directional translation in the Y direction relative to frame 1002. For example, actuator 1306 includes at least one of a hydraulic jack, an air cylinder, a mechanical linkage, a servomechanism, and another suitable mechanical or electronic actuator.

Bearing structure 1314 is moveable between a first position adjacent second feed section 1150, to facilitate extraction of second blank 210 from second feed section 1150, and a second position adjacent deck 1250, to facilitate placement of second blank 210 on deck 1250 such that leading edge 274 of second blank 210 is carried past leading edge 128 of first blank 10, opposite the Y direction, by predetermined overlap distance d (shown in FIG. 3). In alternative embodiments, bearing structure 1314 is fixed with respect to frame 1002, and rotation of drive shaft 1312 is sufficient to carry leading edge 274 past leading edge 128 by predetermined overlap distance d.

Moreover, in the example embodiment, second transfer assembly 1302 includes a position sensor 1350 (shown in FIG. 6) coupled to and/or otherwise associated with frame 1002, and operably coupled to control system 1004. Position sensor 1350 is configured to sense a position of second blank 210 relative to first blank 10 positioned on deck 1250, to facilitate more precise placement of second blank 210 relative to first blank 10 on deck 1250. For example, but not by way of limitation, position sensor 1350 is a photo eye aligned with leading edge 128 of first blank 10 when first blank 10 is positioned on deck 1250. Moreover, after drive shaft 1312 rotates second blank 210 to be generally parallel with first blank 10 and as actuator 1306 translates second blank 210 into position with respect to first blank 10, position sensor 1350 is configured to sense when leading edge 274 of second blank 210 crosses leading edge 128 of first blank 10. Control system 1004 is operably coupled to actuator 1306 such that bearing structure 1314 carries leading edge 274 past leading edge 128 precisely by predetermined overlap distance d, based on feedback from position sensor 1350, thus ensuring precise alignment of first blank 10 and second blank 210 to form joined blank assembly 310. In alternative embodiments, position sensor 1350 and control system 1004 are configured in any other suitable fashion that enables precise placement of second blank 210 relative to first blank 10 on deck 1250. In other alternative embodiments, second transfer assembly 1302 does not include position sensor 1350. For example, in some such embodiments, actuator 1306 is configured to translate bearing structure 1314 in an open loop configuration to obtain predetermined overlap distance d.

Further in the example embodiment, a plunger 1316 extends from, and rotates with, drive shaft 1312. FIG. 9 illustrates plunger 1316 in a retracted condition, and FIG. 10 illustrates plunger 1316 in an extended condition. For example, plunger 1316 includes at least one of a hydraulic jack, an air cylinder, a mechanical linkage, a servomechanism, and another suitable mechanical or electronic actuator. A plurality of vacuum suction cups 1320 is fixedly coupled to plunger 1316. Each suction cup 1320 is operably coupled to a respective independent vacuum generator (not shown) for selectively providing suction to selectively attach suction cups 1320 to second blank 210 presented in second feed section 1150. In alternative embodiments, at least some suction cups 1320 are coupled to a common vacuum generator.

Plunger 1316 is oriented with respect to drive shaft 1312 such that, when bearing structure 1314 is in the first position and drive shaft 1312 is rotated into a position that enables suction cups 1320 to extract second blank 210 from second feed section 1150, plunger 1316 is operable for extension and retraction in a direction generally perpendicular to blank 210 presented in second feed section 1150. Additionally, plunger 1316 is oriented with respect to drive shaft 1312 such that, when bearing structure 1314 is in the second position and drive shaft 1312 is rotated such that second blank 210 is positioned generally parallel to first blank 10 resting on deck 1250, plunger 1316 is operable for extension and retraction in the Z direction. More specifically, plunger 1316 is operable to move suction cups 1320 towards deck 1250 prior to releasing second blank 210 from suction cups 1320, to facilitate maintaining accurate placement of second blank 210 with respect to first blank 10. Plunger 1316 is further operable to move suction cups 1320 away from deck 1250 to facilitate rotating second transfer assembly 1302 back to extract another second blank 210. In alternative embodiments, second transfer assembly 1302 does not include plunger 1316, and plurality of vacuum suction cups 1320 are coupled to drive shaft 1312 in any suitable fashion that enables second transfer assembly 1302 to function as described herein.

In the example embodiment, at least one adhesive applicator 1330 is coupled to bearing structure 1314. Each adhesive applicator 1330 is positioned on bearing structure 1314 relative to the X direction to align with one of fixing areas 140 (shown in FIG. 1) of first blank 10 positioned on deck 1250. Each adhesive applicator 1330 is configured to apply a suitable adhesive to the corresponding fixing area 140 as bearing structure 1314 translates parallel to the Y direction towards the second position (adjacent to deck 1250). In alternative embodiments, adhesive is applied to at least one of fixing areas 140 first blank 10 and fixing areas 270 (shown in FIG. 2) of second blank 210 in any suitable fashion.

Also in the example embodiment, at least one compression member 1340 is coupled to bearing structure 1314 of second transfer assembly 1302. FIG. 9 illustrates compression members 1340 in a retracted condition, and FIG. 10 illustrates compression members 1340 in an extended condition. Each compression member 1340 is operable for extension and retraction in the Z direction. For example, each compression member 1340 includes at least one of a hydraulic jack, an air cylinder, a mechanical linkage, a servomechanism, and another suitable mechanical or electronic actuator. Moreover, each compression member 1340 in the extended condition is configured to compress overlying portions of second blank 210 and first blank 10 together against deck 1250 to facilitate adhering second blank 210 to first blank 10 to form joined blank assembly 310. In the example embodiment, each compression member 1340 is positioned on bearing structure 1314 relative to the X direction and Y direction to align with one of the overlying pairs of fixing areas 140 (shown in FIG. 1) and 270 (shown in FIG. 2) when first blank 10 and second blank 210 are positioned on deck 1250 and bearing structure 1314 is in the second position (adjacent to deck 1250). In alternative embodiments, the at least one compression member 1340 is positioned on bearing structure 1314 in any suitable location that facilitates coupling first blank 10 and second blank 210. In other alternative embodiments, machine 1000 includes any suitable additional or alternative structure that facilitates coupling first blank 10 and second blank 210.

In certain embodiments, second transfer assembly 1302 includes at least one squaring assembly 1360 configured to orient leading edge 274 of second blank 210 parallel with leading edge 128 of first blank 10. In the example embodiment, squaring assembly 1360 is positioned relative to drive shaft 1312 such that leading edge 274 of second blank 210 bears against squaring assembly 1360 after drive shaft 1312 rotates the extracted second blank 210 into a plane parallel with first blank 10. Further in the example embodiment, squaring assembly 1360 is coupled to bearing structure 1314. In alternative embodiments, squaring assembly 1360 is coupled to and/or otherwise associated with frame 1002 in any suitable fashion. In other alternative embodiments, second transfer assembly 1302 does not include squaring assembly 1360.

Figure 11:
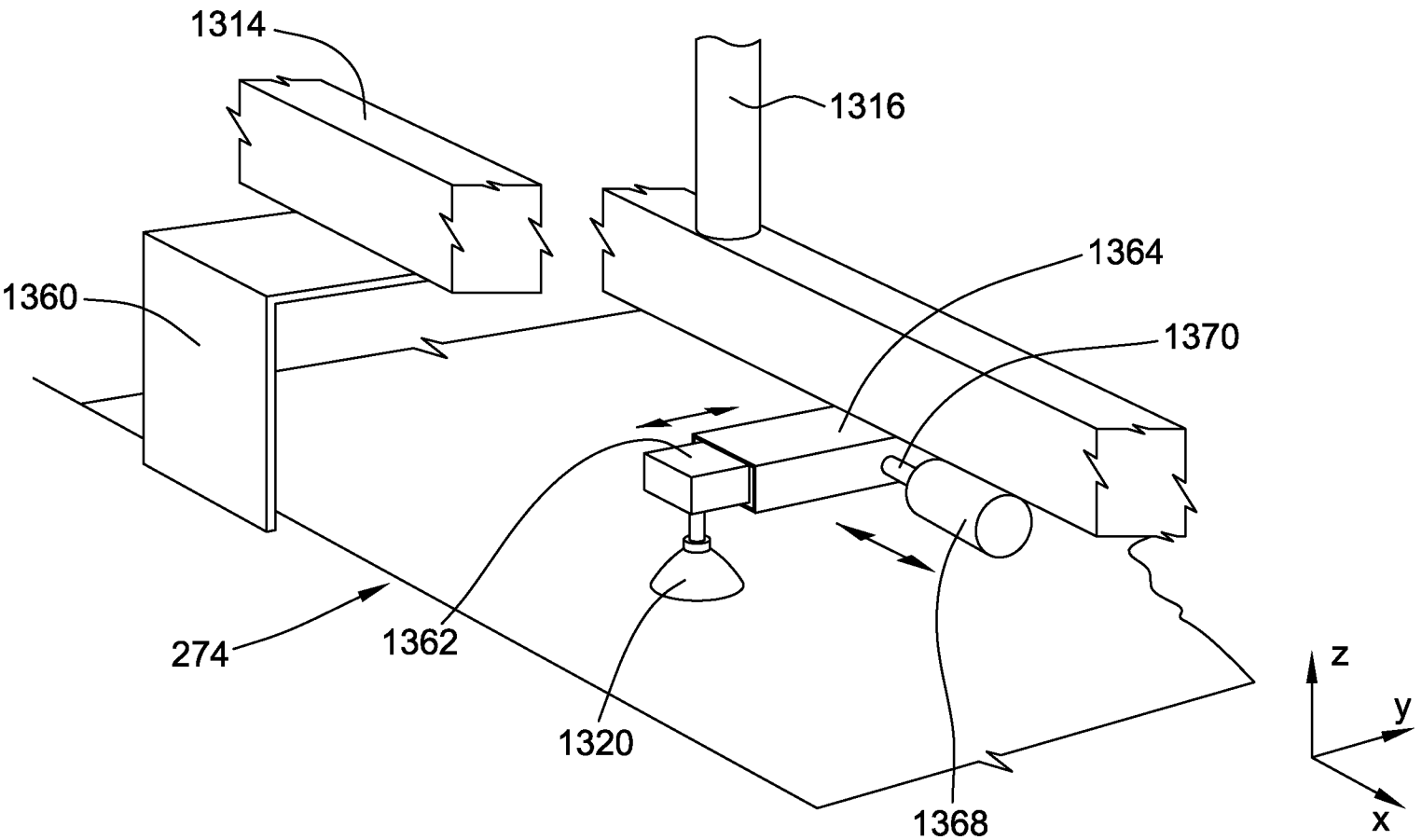
FIG. 11 is a schematic perspective view of an example embodiment of a squaring assembly for use with the example second transfer assembly shown in FIGS. 9 and 10.

FIG. 11 is a schematic perspective view of an example embodiment of squaring assembly 1360. In the example embodiment, each suction cup 1320 is movably coupled to plunger 1316 for slidable adjustment in the Y direction relative to plunger 1316. Thus, second blank 210 coupled to suction cups 1320 is adjustable in the Y direction relative to bearing frame 1314 to accommodate leading edge 274 bearing against squaring members 1360. For example, in the example embodiment, each suction cup 1320 is coupled to a respective rod 1362 slidably received in a respective hollow member 1364. Each hollow member 1364 is fixedly coupled to plunger 1316. A biasing member (not visible), such as a spring, is coupled within hollow member 1364 and biases rod 1362 opposite the Y direction toward squaring members 1360, such that leading edge 274 of second blank 210 is urged against squaring members 1360. In alternative embodiments, squaring assembly 1360 includes any suitable additional or alternative structure configured to square leading edge 274 relative to first blank 10.

Moreover, in certain embodiments, a position of at least one suction cup 1320 is releasably lockable with respect to plunger 1316 to maintain second blank 210 in the "squared" orientation when plunger 1316 is extended opposite the Z direction and leading edge 274 moves out of contact with squaring assembly 1360. For example, in some embodiments, second transfer assembly 1302 includes four suction cups 1320 (not shown) disposed in a series parallel to the X direction, and only the first and last suction cups 1320 in the series are releasably lockable with respect to plunger 1316 to maintain second blank 210 in the "squared" orientation when plunger 1316 is extended opposite the Z direction and leading edge 274 moves out of contact with squaring assembly 1360. In alternative embodiments, any suitable number of suction cups 1320 is releasably lockable with respect to plunger 1316.

In the example embodiment, each rod 1362 of the lockable suction cups 1320 is releasably lockable with respect to the respective hollow member 1364 by a pin 1370 operably coupled to a locking actuator 1368 for movement generally perpendicular to the Y direction. For example, locking actuator 1368 includes at least one of a hydraulic jack, an air cylinder, a mechanical linkage, a servomechanism, and another suitable mechanical or electronic actuator. More specifically, pin 1370 extends through an opening in hollow member 1364 and, when extended, applies a frictional force to rod 1362, securing rod 1362 in place with respect to hollow member 1364. When another second blank 210 is coupled to suction cups 1320, pin 1370 is retracted to unlock rod 1362, again enabling suction cups 1320 to move parallel to the Y direction and leading edge 274 to be squared against squaring assembly 1360. In alternative embodiments, second transfer assembly 1302 includes additional or alternative structure that enables leading edge 274 to be maintained in squared orientation relative to first blank 10. In other alternative embodiments, no suction cups 1320 are releasably lockable with respect to plunger 1316.

In alternative embodiments, second transfer assembly 1302 includes any suitable additional or alternative components that enable second transfer assembly 1302 to transfer second blank 210 into position on deck 1250 as described herein.

With reference to FIGS. 1-3 and 9-11, in operation, second transfer assembly 1302 is controlled, commanded, and/or instructed to position suction cups 1320 to facilitate extracting second blank 210 from second feed section 1150 and placing second blank 210 in a predetermined, at least partially overlying relationship with first blank 10 on deck 1250 to form joined blank assembly 310. More specifically, in the example embodiment, actuator 1306 is controlled, commanded, and/or instructed to translate bearing structure 1314 in the Y direction to the first position adjacent second feed section 1150, and actuator 1308 is controlled, commanded, and/or instructed to rotate drive shaft 1312 in a first direction (counterclockwise in the view of FIGS. 9 and 10), such that suction cups 1320 are adjacent to and oriented towards second blank 210, which is presented generally perpendicular to sheet loading direction Y in second feed section 1150. Plunger 1316 is controlled, commanded, and/or instructed to extend and vacuum pressure in suction cups 1320 is controlled, commanded, and/or instructed to be activated, such that suction cups 1320 are coupled in sealing contact with second blank 210. Plunger 1316 is then controlled, commanded, and/or instructed to retract, such that activated suction cups 1320 extract second blank 210 from second feed section 1150. Actuator 1308 is controlled, commanded, and/or instructed to rotate drive shaft 1312 in a second, opposite direction (clockwise in the view of FIGS. 9 and 10), such that second blank 210 is oriented generally perpendicular to vertical direction Z and, thus, generally parallel to first blank 10. In certain embodiments, leading edge 274 of second blank 210 is squared against squaring assembly 1360, precisely orienting leading edge 274 parallel to leading edge 128 of first blank 10. Moreover, in some embodiments, locking actuator 1368 is controlled, commanded, and/or instructed to lock a position of suction cups 1320 relative to plunger 1316, such that the squared orientation of leading edge 274 is maintained.

Further in operation, prior to, simultaneously, and/or subsequently to rotation of drive shaft 1312 in the second direction, bearing structure 1314 is translated opposite the Y direction to the second position adjacent deck 1250, such that leading edge 274 of second blank 210 is carried past leading edge 128 opposite the Y direction by predetermined overlap distance d (shown in FIG. 3). In some embodiments, position sensor 1350 senses a position of second blank 210 relative to first blank 10 positioned on deck 1250, and actuator 1306 is controlled, commanded, and/or instructed such that bearing structure 1314 carries leading edge 274 past leading edge 128 by precisely predetermined overlap distance d. As bearing structure 1314 is translated opposite the Y direction to the second position, adhesive applicators 1330 are activated to apply adhesive to fixing areas 140 of first blank 10.

Further in operation, after or in conjunction with bearing structure 1314 reaching the second position, plunger 1316 is extended opposite the Z direction, such that the extracted second blank 210 is positioned on or proximate first blank 10 on deck 1250, thus minimizing a distance that second blank 210 can drift in the X and/or Y directions after second blank 210 is released from suction cups 1320. Vacuum pressure through suction cups 1320 is controlled, commanded, and/or instructed to be de-activated, depositing second blank 210 in at least partially overlying relationship with first blank 10 on deck 1250. Compression members 1340 are controlled, commanded, and/or instructed to extend and compress second blank 210 and first blank 10 together against deck 1250, adhering second blank 210 to first blank 10 to form joined blank assembly 310. Compression members 1340 and plunger 1316 are retracted, bearing structure 1314 is translated in the Y direction towards second feed section 1150, and drive shaft 1312 is rotated in the first direction to extract another second blank 210 and/or to pause in a neutral position to provide clearance for other operations of machine 1000 proximate deck 1250. In alternative embodiments, second transfer assembly 1302 is operated in any suitable additional or alternative fashion that enable second transfer assembly 1302 to function as described herein.

Figure 12:
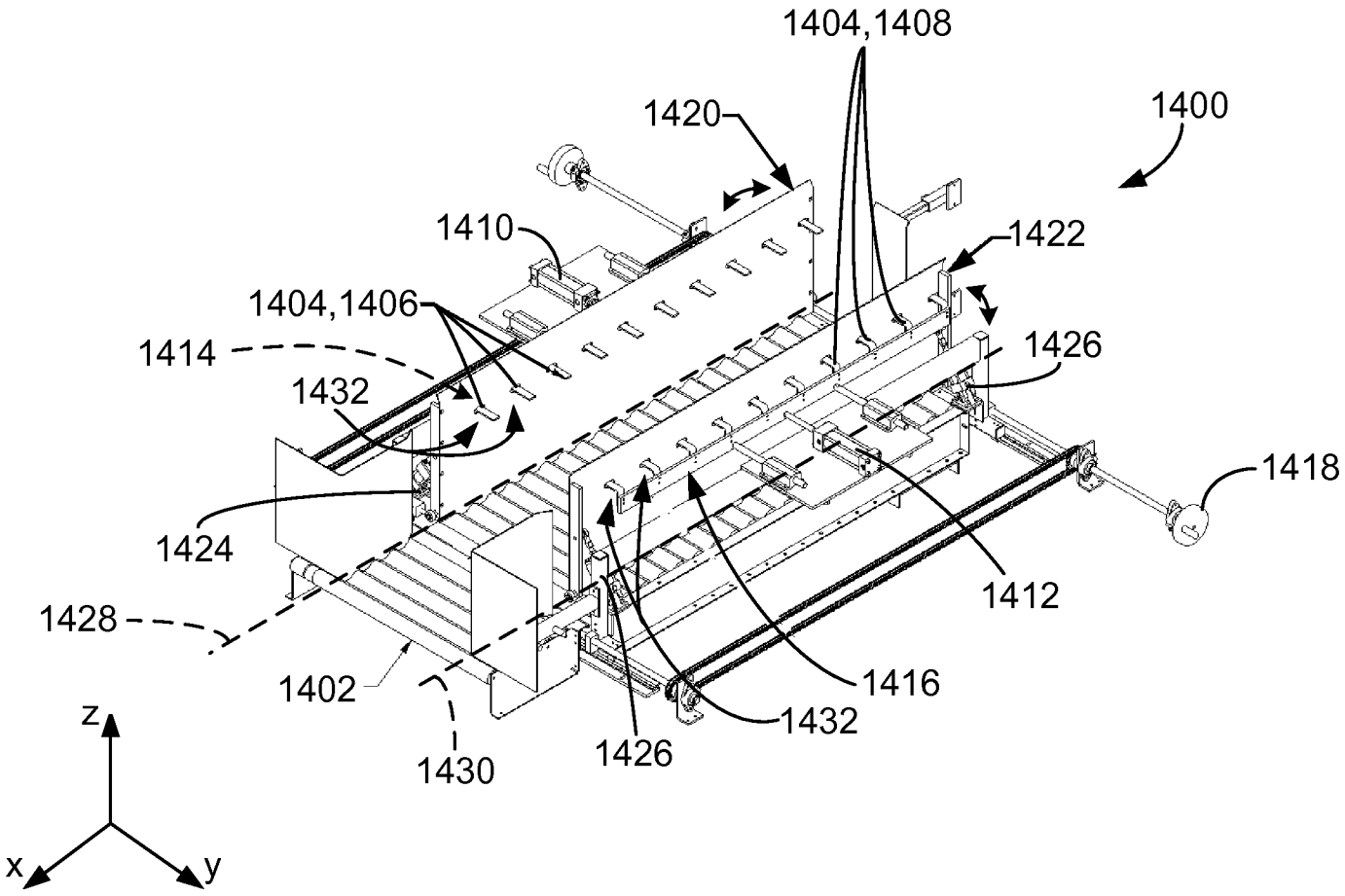
FIG. 12 is a schematic perspective view of an example embodiment of an outfeed section of the machine shown in FIG. 6.

FIG. 12 is a schematic perspective view of an example embodiment of outfeed section 1400. With reference to FIGS. 6 and 12, in the example embodiment, outfeed section 1400 is coupled to and/or otherwise associated with frame 1002 and positioned beneath deck 1250 with respect to the Z direction. More specifically, after joined blank assembly 310 is formed, deck 1250 is moved to the second deck position, as described above, enabling joined blank assembly 310 to move under force of gravity opposite the Z direction into outfeed section 1400. In alternative embodiments, machine 1000 includes any suitable additional or alternative structure that enables joined blank assembly 310 to be moved from deck 1250 to outfeed section 1400.

In the example embodiment, outfeed section 1400 is configured to collect a predetermined number of joined blank assemblies 310 formed on deck 1250, and to discharge collected blanks 310 in batches in discharge direction X. More specifically, in the example embodiment, outfeed section 1400 includes a retractable support 1404 positioned above a conveyor 1402 with respect to the Z direction. Retractable support 1404 is selectively moveable between a first support position, in which retractable support 1404 is configured to receive and support joined blank assemblies 310 as they drop from deck 1250 above, and a second support position, in which retractable support 1404 is configured to enable joined blank assemblies 310 to drop, with respect to vertical direction Z, onto conveyor 1402. Conveyor 1402 is operably coupled to a suitable conveyor actuator 1418 to selectively convey joined blank assemblies 310, stacked one atop another in the Z direction on conveyor 1402, out of outfeed section 1400 in the X direction. In alternative embodiments, outfeed section 1400 includes suitable additional or alternative structure that enables discharge of a plurality of joined blank assemblies 310 in batches. In other alternative embodiments, outfeed section 1400 is configured to discharge joined blank assemblies 310 singly and in series.

In the example embodiment, retractable support 1404 includes a first and second plurality of retractable fingers 1406 and 1408, respectively, disposed on opposite sides of conveyor 1402 with respect to the Y direction. In the first support position, first retractable fingers 1406 are separated from second retractable fingers 1406 by a distance less than height $H_3$ (shown in FIG. 3) of joined blank assembly 310. In the second support position, first retractable fingers 1406 are separated from second retractable fingers 1408 by a distance greater than height $H_3$. Retractable fingers 1406 are operably coupled to a first support actuator 1410 via a first coupling member 1414, and retractable fingers 1408 are operably coupled to a second support actuator 1412 via a second coupling member 1416. For example, each of support actuators 1410 and 1412 includes at least one of a hydraulic jack, an air cylinder, a mechanical linkage, a servomechanism, and another suitable mechanical or electronic actuator. Each support actuator 1410 and 1412 is configured to selectively bi-directionally translate retractable fingers 1406 and 1408, respectively, towards and away from each other in a direction generally parallel to sheet loading direction Y. In alternative embodiments, retractable fingers 1406 and 1408 are selectively moveable between the first support position and the second support position in any suitable fashion that enables retractable support 1404 to function as described herein.

Also in the example embodiment, outfeed section 1400 includes a first pivotable wall 1420 and a second pivotable wall 1422 disposed on opposite sides of conveyor 1402 with respect to the Y direction. First pivotable wall 1420 is pivotably coupled to frame 1002 for bi-directional rotation about a first pivot axis 1428 that is generally parallel to the X direction and proximate conveyor 1402, and second pivotable wall 1422 is pivotably coupled to frame 1002 for bi-directional rotation about a second pivot axis 1430 that is generally parallel to the X direction and proximate conveyor 1402. First pivotable wall 1420 is operably coupled to at least one first pivot actuator 1424, and second pivotable wall 1422 is operably coupled to at least one second pivot actuator 1426. For example, each of pivot actuators 1424 and 1426 includes at least one of a hydraulic jack, an air cylinder, a mechanical linkage, a servomechanism, and another suitable mechanical or electronic actuator. First pivot actuator 1424 is configured to repeatedly bi-directionally pivot, or "shake," first pivotable wall 1420 about first pivot axis 1428, and second pivot actuator 1426 is configured to repeatedly bi-directionally pivot, or "shake," second pivotable wall 1422 about second pivot axis 1430, such that respective trailing edges 280 of second blank 210 and trailing edges 126 of first blank 10 of a stack of joined blank assemblies 310 on conveyor 1402 are funneled into alignment by pivotable walls 1420 and 1422. Thus, pivotable walls 1420 and 1422 facilitate maintaining the stack of joined blank assemblies 310 in alignment with respect to the Y direction each time a plurality of joined blank assemblies 310 is dropped from retractable support 1404 to conveyor 1402. In alternative embodiments, outfeed section 1400 includes suitable additional or alternative structure to facilitate maintaining the stack of joined blank assemblies 310 in alignment with respect to the Y direction each time a plurality of joined blank assemblies 310 is dropped from retractable support 1404 to conveyor 1402. In other alternative embodiments, outfeed section 1400 does not include any structure to facilitate maintaining the stack of joined blank assemblies 310 in alignment with respect to the Y direction each time a plurality of joined blank assemblies 310 is dropped from retractable support 1404 to conveyor 1402.

In the example embodiment, each of first retractable fingers 1406 extends through a respective opening 1432 defined through first pivotable wall 1420, and each of second retractable fingers 1408 extends through a respective opening 1432 defined through second pivotable wall 1422. Openings 1432 are configured such that retraction and extension of retractable fingers 1406 and 1408 does not interfere with the bi-directional pivoting of pivotable walls 1420 and 1422. In alternative embodiments, retractable fingers 1406 and 1408 are positioned above respective pivotable walls 1420 and 1422 with respect to the Z direction, such that retraction and extension of retractable fingers 1406 and 1408 does not interfere with the bi-directional pivoting of pivotable walls 1420 and 1422. In other alternative embodiments, retractable fingers 1406 and 1408 are positioned in any suitable fashion with respect to pivotable walls 1420 and 1422 that enables outfeed section 1400 to function as described herein.

In operation, as a first of a first set of joined blank assemblies 310 is formed on deck 1250, support actuators 1410 and 1412 are controlled, commanded, and/or instructed to place retractable fingers 1406 and 1408 in the first support position to receive the first set of joined blank assemblies 310. Moreover, after each joined blank assembly 310 of the first set of joined blank assemblies 310 is formed on deck 1250, deck actuators 1257 and 1258 are controlled, commanded, and/or instructed to place deck members 1252 and 1254 in the second deck position, such that each joined blank assembly 310 of the first set drops therebetween with respect to vertical direction Z and is received as part of a stack of joined blank assemblies 310 atop retractable fingers 1406 and 1408.

Further in operation, after the last joined blank assembly 310 of the first set of joined blank assemblies 310 is received atop retractable fingers 1406 and 1408 from deck 1250, support actuators 1410 and 1412 are controlled, commanded, and/or instructed to place retractable fingers 1406 and 1408 in the second support position, such that the first set of joined blank assemblies 310 drops therebetween, with respect to vertical direction Z, onto conveyor 1402. In some embodiments, first and second pivot actuators 1424 and 1426 are controlled, commanded, and/or instructed to repeatedly bi-directionally pivot, or "shake," pivotable walls 1420 and 1422 to facilitate aligning joined blank assemblies 310 collected on conveyor 1402 in the Y direction. In the example embodiment, conveyor actuator 1418 is controlled, commanded, and/or instructed to hold conveyor 1402 in place to accumulate further sets of joined blank assemblies 310. In alternative embodiments, conveyor actuator 1418 is controlled, commanded, and/or instructed to discharge the first set of joined blank assemblies 310 from outfeed section 1400 in the X direction.

Further in operation, after the first set of joined blank assemblies 310 is released through retractable support 1404, support actuators 1410 and 1412 are controlled, commanded, and/or instructed to return retractable fingers 1406 and 1408 to the first support position to collect a second set of joined blank assemblies 310. In certain embodiments, a first joined blank assembly 310 of the second set of joined blank assemblies 310 is simultaneously formed on deck 1250 as the first set of joined blank assemblies 310 is received on conveyor 1402. Thus, outfeed section 1400 operating in batch mode facilitates uninterrupted high-speed production of joined blank assemblies 310. After the second set of joined blank assemblies 310 is collected on retractable fingers 1406 and 1408 in similar fashion as was the first set of joined blank assemblies 310, support actuators 1410 and 1412 again are controlled, commanded, and/or instructed to place retractable fingers 1406 and 1408 in the second support position, such that the second set of joined blank assemblies 310 drops therebetween, with respect to vertical direction Z, onto the first set of joined blanks atop conveyor 1402. After a predetermined number of sets of joined blank assemblies 310 is accumulated atop conveyor 1402, conveyor actuator 1418 is controlled, commanded, and/or instructed to discharge the predetermined number of sets of joined blank assemblies 310 from outfeed section 1400 in the X direction. In some embodiments, joined blank assemblies 310 are fed to a container-forming machine configured to form a container, such as container 400 (shown in FIG. 4), from a blank of sheet material.

Figure 13:
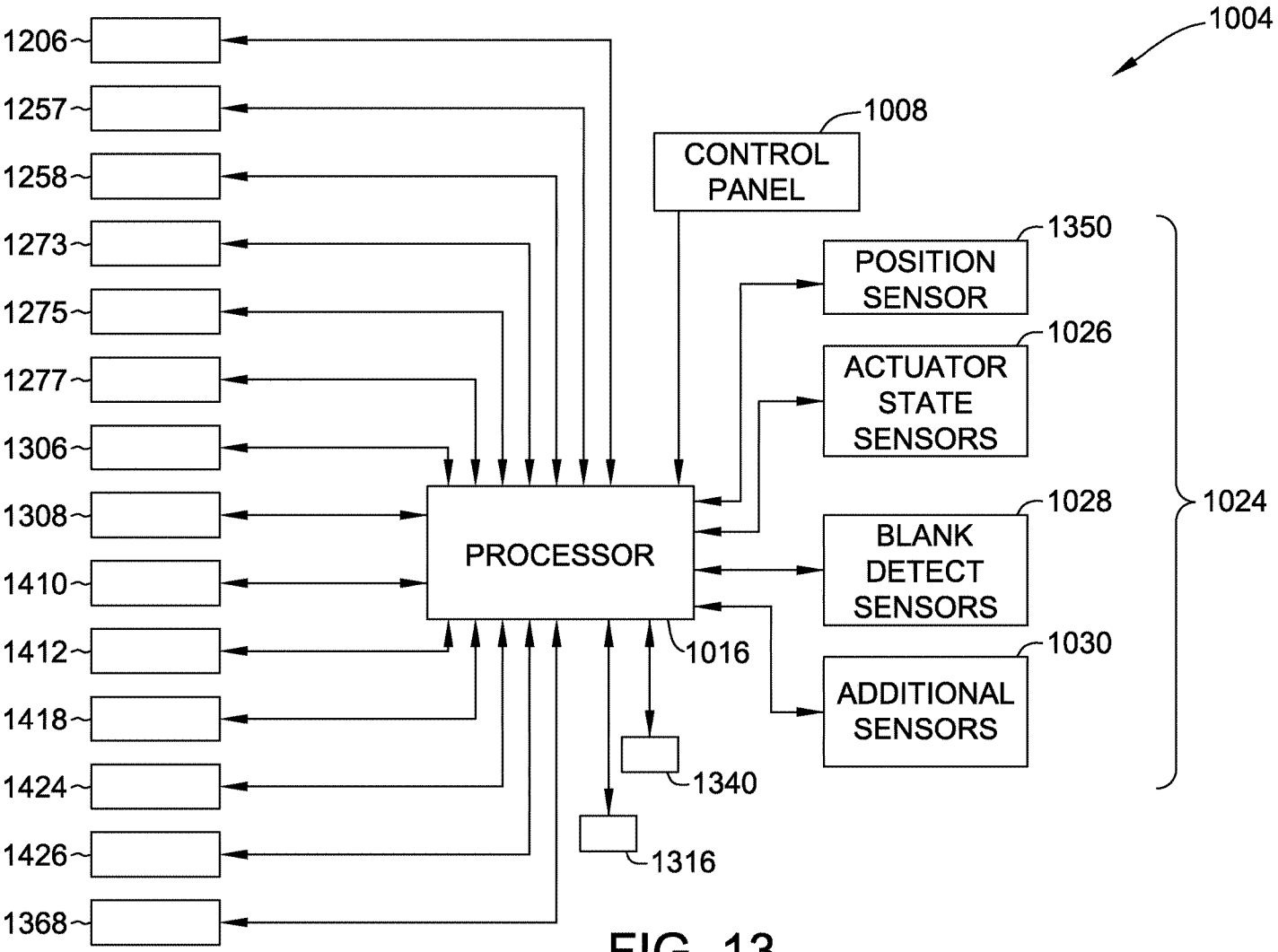
FIG. 13 is a schematic block diagram of an example embodiment of a control system that may be used with the machine shown in FIG. 6.

FIG. 13 is a schematic block diagram of an example embodiment of control system 1004. In the example embodiment, control system 1004 includes at least one control panel 1008 and at least one processor 1016. In certain embodiments, reprogrammed recipes or protocols embodied on a non-transitory computer-readable medium are programmed in and/or uploaded into processor 1016 and such recipes include, but are not limited to, predetermined speed and timing profiles, wherein each profile is associated with blanks of a predetermined size and shape.

In the example embodiment, one or more of actuators 1206, 1257, 1258, 1273, 1275, 1277, 1306, 1308, 1368, 1410, 1412, 1418, 1424, 1426, and the actuators associated with plunger 1316 and compression member 1340 are integrated with machine control system 1004, such that control system 1004 is configured to transmit signals to each actuator to control its operation. Moreover, a plurality of suitable sensors 1024 are disposed on machine 1000 and provide feedback to control system 1004 to enable machine 1000 to function as described herein. For example, plurality of sensors 1024 includes position sensor 1350. In certain embodiments, sensors 1024 also include a first set 1026 of sensors to monitor a state of one or more of actuators 1206, 1257, 1258, 1273, 1275, 1277, 1306, 1308, 1368, 1410, 1412, 1418, 1424, 1426, and the actuators associated with plunger 1316 and compression member 1340, wherein the state includes at least a position of the respective actuator. In addition, in some embodiments, machine 1000 is configured to assemble joined blank assemblies 310 of any size and any shape without limitation. Therefore, to accommodate the assembly of such a large variety of joined blank assemblies 310, plurality of sensors 1024 includes a second set 1028 of suitable sensors to enable machine control system 1004 to automatically detect dimensional features of first blanks 10 and second blanks 210 of varying shapes and sizes, including, but not limited to, length, width, and/or depth. In some embodiments, plurality of sensors 1024 also includes a variety of additional sensors 1030 suitable for enabling control system 1004 and machine 1000 to operate as described herein.

Control system 1004 is configured to coordinate the movements of first transfer assembly 1202, second transfer assembly 1302, deck 1250, outfeed section 1400, and/or other components of machine 1000 to enable high-speed, fully automated production of joined blank assemblies 310 from first blanks 10 and second blanks 210. In certain embodiments, control system 1004 is configured to facilitate selecting a speed and timing of the movement of each of the devices and/or components associated with at least one of actuators 1206, 1257, 1258, 1273, 1275, 1277, 1306, 1308, 1368, 1410, 1412, 1418, 1424, 1426, and the actuators associated with plunger 1316 and compression member 1340 to facilitate improved coordination with other components of machine 1000 and, thus, an improved speed and efficiency of forming and discharging joined blank assemblies 310. The devices and/or components may be controlled either independently or as part of one or more linked mechanisms. For example, in embodiments where one or more of actuators 1206, 1257, 1258, 1273, 1275, 1277, 1306, 1308, 1368, 1410, 1412, 1418, 1424, 1426, and the actuators associated with plunger 1316 and compression member 1340 is a servomechanism, the speed and timing of each such actuator can be controlled independently, as commanded by control system 1004, to facilitate further improved coordination with other components of machine 1000.

Moreover, in some embodiments, control system 1004 is capable of adjusting the movements of first transfer assembly 1202, second transfer assembly 1302, deck 1250, outfeed section 1400, and/or other components of machine 1000 to accommodate different types and sizes of first blank 10, second blank 210, and/or joined blank assembly 310, thus maintaining an improved speed and efficiency of forming and discharging joined blank assemblies 310 with a reduced or eliminated need for manual adjustments to machine 1000. In certain embodiments, control panel 1008 allows an operator to select a recipe that is appropriate for a particular joined blank assembly 310. The operator typically does not have sufficient access rights/capabilities to alter the recipes, although select users can be given privileges to create and/or edit recipes. Each recipe is a set of computer instructions that instruct machine 1000 as to forming the joined blank assembly 310. For example, machine 1000 is instructed as to speed and timing of picking a first blank 10 from first feed section 1100, speed and timing of picking a second blank 210 from second feed section 1150, speed and timing of compressing the first and second blanks together to form joined blank assembly 310, speed and timing of moving deck 1250 to the second position to deposit joined blank assembly 310 in outfeed section 1400, speed and timing of moving retractable support 1404 to the second position to deposit a set of joined blank assemblies 310 on conveyor 1402, and speed and timing of operating conveyor 1402 to discharge joined blank assemblies 310. In embodiments where one or more actuators is a servomechanism, control system 1004 is able to control the movement of each such actuator independently relative to any other component of machine 1000. This enables an operator to maximize the number of joined blank assemblies 310 that can be formed by machine 1000, easily change the size of joined blank assemblies 310 being formed on machine 1000, and automatically change the type of joined blank assemblies 310 being formed on machine 1000 while requiring limited or no manual adjustment of machine 1000.

Embodiments of a machine and method for forming a joined blank from first and second blanks of sheet material are described herein. The embodiments provide an advantage over at least some known methods for forming containers having multiple blanks. For example, the embodiments described herein enable the production of stacked sets of joined blank assemblies suitable for loading directly into a container-forming machine that was designed to operate on a single blank of sheet material. Thus, the embodiments described herein enable formation of containers having a much wider range of appearances, stacking strengths, retail-ready display features, and other characteristics using existing container-forming machines.

Exemplary embodiments of a machine and method for forming a joined blank from first and second blanks of sheet material are described above in detail. The methods and machine are not limited to the specific embodiments described herein, but rather, components of systems and/or steps of the methods may be utilized independently and separately from other components and/or steps described herein. For example, the machine may also be used in combination with other blanks and containers, and is not limited to practice with only the blank and container described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to illustrate the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A machine for forming a joined blank assembly from a first blank of sheet material and a second blank of sheet material, said machine comprising:

a deck coupled to a frame;

a first transfer assembly associated with said frame, said first transfer assembly configured to position the first blank on said deck;

a second transfer assembly associated with said frame, said second transfer assembly configured to position the second blank in at least a partially overlying relationship to the first blank on said deck; and at least one compression member configured to compress the second blank and the first blank together against said deck to form the joined blank assembly;

wherein said first transfer assembly is configured to extract the first blank from a first feed section and said second transfer assembly is configured to extract the second blank from a second feed section, said first feed section and said second feed section are positioned on opposite sides of said deck with respect to a sheet loading direction;

further comprising an outfeed section configured to discharge the joined blank assembly in a discharge direction that is perpendicular to the sheet loading direction;

wherein said outfeed section is located at least partially beneath said deck;

wherein said deck is selectively moveable between a first deck position, in which said deck is configured to support the first and second blanks as they are coupled to form the joined blank assembly, and a second deck position, in which said deck is configured to enable the joined blank assembly to drop, in a vertical direction, into said outfeed section;

wherein said outfeed section includes a retractable support positioned above a conveyor;

wherein said retractable support is selectively moveable between a first support position, in which said retractable support is configured to receive and support the joined blank assembly received from said deck, and a second support position, in which said retractable support is configured to enable the joined blank assembly to drop, in the vertical direction, to said conveyor.

2. The machine in accordance with claim 1, wherein said second transfer assembly comprises a drive shaft operably coupled to a drive shaft actuator for selective bi-directional rotation, said drive shaft configured to rotate the second blank from a first orientation to a second orientation that is parallel to the first blank positioned on said deck.

3. The machine in accordance with claim 2, further comprising a plunger coupled to said drive shaft for rotation with said drive shaft, said plunger is operable to move the second blank towards said deck.

4. The machine in accordance with claim 1, further comprising a bearing structure operably coupled to a bearing structure actuator for selective bi-directional translation of said bearing structure, said selective bi-directional translation being parallel to a sheet loading direction, said bearing structure configured to align the second blank with the first blank in the sheet loading direction.

5. The machine in accordance with claim 4, further comprising a position sensor associated with said frame, said position sensor configured to sense a position of the second blank relative to the first blank positioned on said deck, said bearing structure actuator operably coupled to said position sensor such that said bearing structure is configured to carry a leading edge of the second blank past a leading edge of the first blank in the sheet loading direction by a predetermined overlap distance.

6. The machine in accordance with claim 1, further comprising a first tamp and a first stop positioned on opposite sides of said deck, said first tamp is operable to couple a leading edge of the first blank against said first stop when the first blank is positioned on said deck.

7. The machine in accordance with claim 6, wherein said first stop is selectively moveable between a first position above said deck, in which the leading edge of the first blank is coupleable against said first stop, and a second position below said deck, in which said first stop is configured to not interfere with the second blank positioned in the at least partially overlying relationship with the first blank.

8. The machine in accordance with claim 1, wherein said at least one compression member is coupled to said second transfer assembly.

9. The machine in accordance with claim 1, further comprising a squaring assembly configured to orient a leading edge of the second blank parallel to a leading edge of the first blank positioned on said deck.

* * * * *